US008038365B2

(12) United States Patent
Quenzi et al.

(10) Patent No.: US 8,038,365 B2
(45) Date of Patent: Oct. 18, 2011

(54) APPARATUS AND METHOD FOR IMPROVING THE CONTROL OF A CONCRETE SCREED HEAD ASSEMBLY

(75) Inventors: Philip J. Quenzi, Atlantic Mine, MI (US); Carl B. Kieranen, Chassell, MI (US); Frank E. Anderson, Atlantic Mine, MI (US); Jeffrey W. Torvinen, South Range, MI (US); Mark A. Pietela, Atlantic Mine, MI (US)

(73) Assignee: Somero Enterprises, Inc., Fort Myers, FL (US)

( * ) Notice: Subject to any disclaimer, the term of this patent is extended or adjusted under 35 U.S.C. 154(b) by 0 days.

(21) Appl. No.: 12/724,867

(22) Filed: Mar. 16, 2010

(65) Prior Publication Data

US 2010/0172695 A1 Jul. 8, 2010

Related U.S. Application Data

(62) Division of application No. 12/166,036, filed on Jul. 1, 2008, now Pat. No. 7,677,834, which is a division of application No. 11/673,010, filed on Feb. 9, 2007, now Pat. No. 7,396,186, which is a division of application No. 11/404,686, filed on Apr. 14, 2006, now Pat. No. 7,175,363, which is a division of application No. 10/804,325, filed on Mar. 19, 2004, now Pat. No. 7,044,681.

(60) Provisional application No. 60/457,260, filed on Mar. 25, 2003.

(51) Int. Cl.
*E01C 23/07* (2006.01)

(52) U.S. Cl. ..... 404/84.1; 404/114; 404/118

(58) Field of Classification Search ..... 404/84.05, 404/84.1, 84.2, 84.5, 114, 118
See application file for complete search history.

(56) References Cited

U.S. PATENT DOCUMENTS

| | | | | |
|---|---|---|---|---|
| 2,796,685 | A | 6/1957 | Bensinger | |
| 3,604,325 | A | 9/1971 | Borges | 94/45 |
| 3,870,427 | A | 3/1975 | Allen | 404/103 |
| RE28,400 | E | 4/1975 | Burgin | |
| 3,953,145 | A | 4/1976 | Teach | 404/84 |
| 4,655,633 | A | 4/1987 | Somero et al. | 404/75 |
| 4,759,657 | A | 7/1988 | Dorr et al. | |
| 4,807,131 | A | 2/1989 | Clegg | 364/424.01 |
| 4,930,935 | A | 6/1990 | Quenzi et al. | 404/75 |
| 4,978,246 | A | 12/1990 | Quenzi et al. | 404/84 |
| 5,039,249 | A | 8/1991 | Hansen et al. | 404/84 |
| 5,129,803 | A | 7/1992 | Nomura et al. | 425/62 |
| 5,156,487 | A | 10/1992 | Haid | 404/72 |
| 5,258,961 | A | 11/1993 | Sehr et al. | 367/96 |
| 5,288,166 | A | 2/1994 | Allen et al. | 404/84.1 |
| 5,288,167 | A | 2/1994 | Gaffard et al. | 404/84.05 |
| 5,328,295 | A | 7/1994 | Allen | 404/84.1 |
| 5,352,063 | A | 10/1994 | Allen et al. | 404/84.1 |
| 5,375,663 | A | 12/1994 | Teach | 172/4.5 |

(Continued)

*Primary Examiner* — Gary S Hartmann
(74) *Attorney, Agent, or Firm* — Gardner, Linn, Burkhart & Flory, LLP

(57) ABSTRACT

A soft landing control system for a screeding device is operable to automatically lower a vibrating member relative to a grade setting device after the grade setting device is lowered to the desired grade. The control may be operable to delay lowering the vibrating member relative to the grade setting device at least until the control receives an input indicative of at least a portion of the screed head assembly being moved to a position generally over a newly placed concrete area.

12 Claims, 33 Drawing Sheets

U.S. PATENT DOCUMENTS

| | | | | |
|---|---|---|---|---|
| 5,549,412 | A | 8/1996 | Malone | 404/84.1 |
| 5,567,075 | A | 10/1996 | Allen | 404/84.5 |
| 5,588,776 | A | 12/1996 | Swisher, Jr. et al. | 404/72 |
| 5,752,783 | A | 5/1998 | Malone | 404/84.2 |
| 5,771,978 | A | 6/1998 | Davidson et al. | 172/4.5 |
| 6,027,282 | A | 2/2000 | Horn | |
| 6,129,481 | A | 10/2000 | Tapio et al. | 404/102 |
| 6,152,647 | A | 11/2000 | Tapio et al. | 404/75 |
| 6,183,160 | B1 | 2/2001 | Tapio et al. | 404/84.1 |
| 6,227,761 | B1 | 5/2001 | Kieranen et al. | 404/84.5 |
| 6,530,720 | B1 | 3/2003 | Green | |
| 6,588,976 | B2 | 7/2003 | Quenzi et al. | 404/84.8 |
| 6,623,208 | B2 | 9/2003 | Quenzi et al. | 404/84.8 |
| 6,752,567 | B2 | 6/2004 | Miyamoto et al. | |
| 6,953,304 | B2 | 10/2005 | Quenzi et al. | |
| 6,976,805 | B2 | 12/2005 | Quenzi et al. | |
| 7,044,681 | B2 | 5/2006 | Quenzi et al. | |
| 7,121,762 | B2 | 10/2006 | Quenzi et al. | |
| 7,175,363 | B2 | 2/2007 | Quenzi et al. | |
| 7,320,558 | B2 * | 1/2008 | Quenzi et al. | 404/75 |
| 7,396,186 | B2 | 7/2008 | Quenzi et al. | |
| 7,491,011 | B2 * | 2/2009 | Quenzi et al. | 404/84.1 |
| 7,559,719 | B2 * | 7/2009 | Nasby | 404/96 |
| 7,677,834 | B2 * | 3/2010 | Quenzi et al. | 404/84.1 |
| 7,850,396 | B2 * | 12/2010 | Pietila et al. | 404/96 |
| 7,891,906 | B2 * | 2/2011 | Quenzi et al. | 404/112 |
| 7,909,533 | B2 * | 3/2011 | Quenzi et al. | 404/114 |

* cited by examiner

APPARATUS AND METHOD FOR IMPROVING THE CONTROL OF A CONCRETE SCREED HEAD ASSEMBLY

CROSS REFERENCE TO RELATED APPLICATIONS

The present application is a divisional of U.S. patent application Ser. No. 12/166,036, filed Jul. 1, 2008, now U.S. Pat. No. 7,677,834, which is a divisional of U.S. patent application Ser. No. 11/673,010, filed Feb. 9, 2007, now U.S. Pat. No. 7,396,186, which is a divisional of U.S. patent application Ser. No. 11/404,686, filed Apr. 14, 2006, now U.S. Pat. No. 7,175,363, which is a divisional of U.S. patent application Ser. No. 10/804,325, filed Mar. 19, 2004 by Quenzi et al., now U.S. Pat. No. 7,044,681, which claims benefit of U.S. provisional application, Ser. No. 60/457,260, filed Mar. 25, 2003 by Torvinen for SCREED HEAD ASSEMBLY, which are hereby incorporated herein by reference in their entireties.

FIELD OF THE INVENTION

The present invention relates generally to an apparatus and method for controlling a concrete screeding assembly during the leveling and smoothing of freshly poured concrete, as well as somewhat partially cured concrete, that has been placed over a surface.

BACKGROUND OF THE INVENTION

There is a continuous and growing need within industry for flat and level close-tolerance concrete floors used in a variety of structures such as office buildings, shopping centers, warehouses, and production and/or manufacturing facilities. Most modern production and manufacturing plants include high-precision machinery and equipment which must be set level on a flat surface. A main benefit from achieving close-tolerance floors is that it will allow for easier installation and set-up of the precision machinery and equipment. This allows a facility to reach its intended level of performance capacity sooner and at a higher level of quality. Facility maintenance costs are also likely to be reduced. When changes to the machinery become necessary, reorganization and set-up of the equipment can also be less costly.

For example, high-density warehouse facilities often utilize narrow aisles and high-reach forklifts to reach tall storage racks containing shelving or storage racks for material goods. Any offset error variation from the desired and ideally level floor can correspond to a proportionally larger vertical offset error at the raised forks of high-reach forklifts. Large vertical offset errors at the forklift forks result in an increasingly greater difficulty in maneuvering the forklift machines along the aisles and while reaching for materials and goods at the upper most shelves. Therefore, flatness or levelness errors in the concrete floor become a limiting factor in the practical design of high-density vertical-storage warehouse facilities. Thus the benefit of having easy to produce smooth and accurately level floors in a high-rise warehouse increases the investment value and efficiency of the facility according to a cost per square foot or cost per square meter basis. In locations where land or real estate values are high or available space is at a premium, such costs are an important factor.

In another example, production facilities containing lines of high precision machinery that must be both level and accurately set with respect to one another also significantly benefit from concrete floors that have been placed accurately and economically. The effort required to adjust or otherwise place shims under the supports of the machinery can be reduced or made unnecessary providing that the concrete floor is accurately level and smooth from the start. This can significantly reduce the cost of initially setting up a production line or later making changes or upgrades to equipment as may be necessary. Smooth and accurately level floors may also contribute to reducing overall maintenance costs related to the equipment over the life cycle of the production facility.

Close-tolerance concrete floors are generally known in the concrete construction industry as "super-flat floors" or simply "super flats". Super-flat floors are typically expensive for building owners to buy and concrete contractors to produce, since such projects usually require specialized equipment and experienced personnel with a thorough working knowledge of the process. Because of the relatively higher cost of the super-flat floors, often only specified areas of a building floor will be made to super-flat specifications, such as within anticipated aisleways of a given floor plan. When changes for the floor plan are necessary however, the spacing and location of the aisle ways cannot be easily adjusted or moved. This limitation increases renovation costs and possibly reduces the future investment value and long-term usefulness of the facility.

Close-tolerance, super-flat concrete floors are specified, measured and compared in the concrete industry according to concrete floor profile specification variables. One of these variables is for floor flatness "F-F" and another is for floor levelness "F-L". These two specifications together are generally referred to in the industry as F-numbers. The F-number system offers a repeatable method for measuring floor quality through statistical means known in the art. Concrete floors having F-numbers near or above the range of F-F 80 and F-L 80 are typically regarded as being super-flat concrete floors.

Super-flat concrete floors are much more difficult and expensive to achieve than those conventionally poured. In order to achieve such super-flat floors, construction work site personnel must be highly trained and skilled, and special equipment is often required to place and finish the concrete. Skilled workers using hand tools can perform the task of striking-off wet, uncured concrete to a specified grade with a conventional floor. However, a large number of workers are required to finish the floor. Production speed of the floor is thus relatively slow with such a conventional process. Additionally, as even the best skilled worker continues to use his tools of the trade, over the course of a day, the worker will fatigue and tire as the day goes on, Human endurance has its typical limitations. This factor can also have an adverse effect on the final F-numbers and quality of the floor. Therefore, because many flat surfaces are finished by manual labor, the surfaces are likely to have relatively poor or inconsistent quality with regard to overall levelness and flatness.

In order to achieve super-flat or otherwise high quality concrete floors, the use of a laser-guided or laser-controlled screeding device, such as the patented LASER SCREED™ screeding machine or device, developed by Somero Enterprises, LLC of Houghton, Mich., may be used to initially level and screed the freshly poured concrete. Other devices or machines for smoothing and screeding uncured concrete that use similar structural elements could be used also. The Somero LASER SCREED™ machine or apparatus and method is described in detail in U.S. Pat. Nos. 4,655,633 and 4,930,935, both entitled SCREEDING APPARATUS AND METHOD, which are hereby incorporated herein by reference. Additionally, U.S. Pat. No. 6,227,761; entitled APPARATUS AND METHOD FOR THREE-DIMENSIONAL CONTOURING, which is hereby incorporated herein by reference, discloses a contouring device and apparatus for producing contoured concrete surfaces over non-flat areas. These would be concrete surfaces such as, for example, those found with driveways, parking lots, paved roads, walkways, and other similar non-planar areas. A detailed review of these inventions will not be included herein but may serve as references as to their specific limitations and help to gain an understanding of the benefits of the invention disclosed herein. For the purposes of illustration and disclosure of the invention herein, a Somero LASER SCREED™ screeding machine will be used as the example.

The typical Somero LASER SCREED™ screeding machine used to produce super flat concrete floors is comprised of essentially the same or similar mechanical elements as that of a standard screeding machine. These elements may include a base machine having a power source supporting a rotatable telescopic boom. The telescopic boom supports a screeding assembly or screed head typically consisting of three elements, a plow, rotating auger, and a vibrating member. The support boom is extended outward over the freshly poured concrete and the screed head is then lowered to the desired grade elevation. The laser control system takes over from this point and the boom is steadily retracted to engage and smooth the concrete. As the boom is retracted, the screed head is continuously controlled by the laser-controlled hydraulic system according to a laser reference plane. This produces a generally level and smoothed concrete surface at the desired elevation. When the boom reaches its retracted position, the screed head is raised out of the concrete. The entire machine is then moved laterally to the next adjacent position and the boom is again extended for another smoothing pass. The screed head is then once again lowered into the concrete where the process is repeated until all the concrete has been leveled and smoothed.

It is important to note that the plow, auger, and vibrator that are on the Somero LASER SCREED™ screeding machine are pivotable about a horizontal axis perpendicular to the direction of travel over the concrete, wherein the pivoting motion is controlled by a set of actuators, such as hydraulic cylinders or the like, via a control system. The control system maintains the proper relative orientation of the screed head components relative to the desired concrete surface throughout any variations of concrete forces against the plow, auger, and vibrator, as well as any horizontal inclination or deflection of the telescopic boom or support structure of the machine. This unique capability is disclosed in detail in U.S. Pat. No. 4,930,935, issued to Quenzi et al., and referred to in U.S. Pat. No. 6,227,761, issued to Kieranen et al., both of which are hereby incorporated herein by reference.

An interesting and significant aspect of existing screed head designs is that the vibrating member is typically set at an elevation that is just slightly below the desired finished surface elevation of the concrete during normal screeding operations. In other words, while the rotating auger cuts, fills, and establishes the concrete at the desired grade, the vibrating member that follows is set slightly below grade. Accordingly, as the concrete is freshly leveled by the auger and the surface is subjected to the final action of the vibrating member, the concrete is essentially pressed downward by the working face of the vibrating member. Due to the resiliency of the freshly poured and smoothed concrete, the vibrated material almost immediately and effectively "springs back" or flows upward, returning to the desired elevation set by the auger. This action is continuous along the full length of the vibrating member. The concrete returns to the desired grade in the wake of the action of the vibrating member as it passes over the concrete. This is a proven characteristic in concrete having typical construction slump consistencies and characteristics. Typically, the trailing edge of the vibrating member is adjusted or set to about $\frac{1}{8}^{th}$ to $\frac{1}{4}^{th}$ of an inch (about 3 mm to 6 mm) below the desired level of the smoothed concrete.

There exist, however, limitations toward achieving super-flat high quality floors that are a result of the above-described physical aspect. When the screed head is lowered down onto the concrete at the beginning of a smoothing pass, it is typically overlapped onto the previously smoothed concrete of the adjacent and/or previous set of passes. Because the vibrator is set at a height just slightly lower than desired grade, the vibrator creates a depression in the concrete surface roughly equivalent to the length and width of the vibrating member. With typical concrete floors having non-critical F-number specifications, the landing depressions created by the vibrating member can be simply disregarded in the process. On the other hand, the landing depressions can be typically reduced or possibly eliminated through manual secondary operations using hand tools such as by use of a "highway straight edge" or "bump cutter" tools. However, access to the concrete surface can be a limitation. Workers using these tools may be greatly limited during "wide placement" site conditions or high rates of production. Final concrete trowling and finishing operations can also help to "hide" the landing depressions. However, the actual accuracy of the finished concrete floor surface is likely to remain in question. With super-flat concrete floors, however, the created landing depressions become an even greater limitation toward achieving high-quality floors having high F-number characteristics.

The degree of the created "landing depression" is often dependent on a number of factors. An experienced screeding machine operator can reduce the creation of landing depressions by the carefully coordinated practice of lowering the screed head into the concrete while beginning retraction of the boom. The vibrator may be turned off temporarily, and then quickly turned back on again just at the correct moment in time during the landing. This coordinated technique is known by some experienced screeding machine operators as a "soft landing". However, such soft landings can be difficult to achieve on a consistent or repeatable basis, and are largely dependent on the level of skill and experience of the screeding machine operator. In addition, the slump condition, degree of cure, and other physical characteristics of the uncured concrete can play a large role in the results.

A further factor beyond that of the control and experience of the operator becomes apparent when soft landings are made on concrete that has already begun to set-up or cure. Concrete that has been leveled and smoothed and then left undisturbed for a period of time will progressively begin to loose its resiliency or ability to flow. The length of time is not easily determined and is subject to many variables such as the prevailing conditions that exist at the site or the mix design of the concrete. Warm, dry and windy conditions may cause the concrete to quickly dry and harden at the surface, while cool and damp conditions may have the opposite effect. Concrete mix designs may also exhibit varying degrees of allowable working time before the resiliency or workability of the material is lost. For example, low slump concrete is by definition stiff and less resilient than high slump concrete, while high-slump concrete flows more readily and smoothly than low-slump concrete and is more easily worked. Also, low slump concrete may be more difficult to work, but often offers higher cure strength by containing less water in the mixing ratio. These variables are important factors with respect to the soft landing of the vibrating member of a LASER SCREED™ screeding machine or other screeding machine when producing high-quality super-flat floors.

A typical wide-placement concrete pour, for example, might consist of a set of eight to sixteen screeding passes from left to right before another row is started. This number of consecutive passes would normally complete the full width of a wide-placement concrete pour. By the time the screeding device returns to the beginning of the next series of smoothing passes, the earlier smoothed concrete may have already begun to set-up. In this case, the screed head must overlap onto the earlier smoothed concrete to produce a substantially continuous and uniform surface. This is where soft landings with the screed head become highly important and valuable. For best results, the vibrating element should not be permitted to substantially or fully engage the already setting concrete within the overlap area of the smoothing pass. If contact between the vibrator and the earlier smoothed concrete is made and sustained, there exists a high likelihood that a landing depression or other irregularity will be created in the previously smoothed and already setting concrete. As the screed head continues onto the freshly poured concrete section, the action of the vibrating member may then again be correct under normal conditions. The area of transition between freshly placed concrete and concrete that has already been screeded and begun to set-up is known in the industry as a "cold joint". Cold joints are usually minimized as much as possible, however the complete elimination of overlap areas is not reasonably practical. Overlapping the screed head onto previously screeded areas is an inherently necessary and accepted part of the process.

Therefore, there is a need in the art for a concrete smoothing and leveling apparatus that is capable of repeatedly and consistently finishing a concrete surface to a close-tolerance or super-flat level of quality. The apparatus should also help to reduce or substantially eliminate manual labor processes and their inherent variations, and should provide less expensive and higher quality concrete floors and surfaces.

SUMMARY OF THE INVENTION

The present invention provides an automatic control system and apparatus for sensing the presence and/or condition of the concrete and temporarily tilting or rotating the screed head assembly of a LASER SCREED™ screeding machine or such similar concrete screeding machines. Alternate to tilting or rotating an entire multi-element screed head assembly, the vibrator alone may be temporarily raised by mechanical means just slightly above the desired grade of the concrete. Accordingly, landing depressions are substantially reduced or eliminated on the concrete surface by the vibrating member as a result of touchdowns or landings of the screed head assembly within overlap areas that have been previously screeded and smoothed.

More specifically, the present invention provides an apparatus and method that improves the control of a concrete screeding assembly during the process of "landing" at the beginning of each screeding pass. Through the use of sensors, mechanical actuators, and an automated controller, and including methods of positioning the vibrating member relative to a screed head assembly in overlap areas, the automated control system of the present invention provides a significant improvement in the surface quality of a concrete floor. The present invention provides a means of sensing the firmness characteristics of the concrete and includes a control system for automatically minimizing the creation of vibrator landing depressions made in the overlap areas of previously screeded concrete. The apparatus and method of the present invention may be generally referred to as a "soft landing" control system for concrete screeding machines.

The present invention provides an automated apparatus and means of preventing the vibrating member from substantially engaging the already set-up concrete a second time in overlap areas. A solution to help solve this problem is to temporarily and independently raise the vibrator relative to the plow and auger. Raising the vibrator up about one quarter inch (6 mm), for example, from the concrete whenever the vibrator is likely to engage previously screeded concrete prevents a second vibration of the material. This is useful where concrete that is beginning to set-up it is not likely to rebound after a second engagement by the vibrator.

The present invention provides an apparatus and method to avoid and minimize the creation of vibrating member depressions in a concrete surface where the screed head re-engages previously screeded concrete material. It also provides a control means for automated and controlled descent of the screed head for re-engagement with the concrete. The apparatus and method of the present invention thus improves the finished surface quality of a screeded concrete surface.

The present invention provides an automatic control system and apparatus for sensing the presence and/or condition of the concrete and providing a signal indicative of such presence and/or condition as an input to a controller. The controller then provides an output signal to automatically achieve a desired adjustment of the concrete screeding head. This includes temporarily tilting or rotating the screed head assembly of a concrete screeding apparatus to raise the vibrating member to reduce or eliminate its engagement with the concrete, or lifting the vibrating member independently with respect to the plow and auger means. Any depressions typically created in the concrete surface by the vibrating member within overlap areas thus become substantially reduced or eliminated.

The screeding device of the present invention thus may include an electronic control feature which may improve the quality and smoothness of the screeded concrete surface by temporarily tilting the screed head, or auger support beam and vibrator, auger and plow, toward the operator as the screed head assembly is lowered onto the uncured concrete or other material surface. The tilting action allows the vibrating device to not penetrate its normal distance (such as approximately 0.25 inches) into the uncured concrete as it is lowered onto the uncured concrete surface. Such an action may be especially useful in landing locations where the uncured concrete has already begun to set up somewhat and has lost its ability to spring back up to the desired grade after the vibrating member has passed over the partially set up concrete material. The soft landing function is intended to improve floor quality F-numbers.

Optionally, the screed head control system may be based on a more detailed software control of the screed head self-leveling system, discussed above. An operator controlled switch on one of the controls of the wheeled base unit of the screeding machine may allow for various mode settings, such as "manual override control", "auto sensor control", "delayed head pivoting based on the travel distance of the telescoping boom" or the like. It is further envisioned that the screed head assembly may include an additional actuator or actuators, such as hydraulic cylinders or the like, operable to raise the vibrating device separately and independently, rather than pivoting the entire auger support beam and screed head.

Optionally, additional sensors (not shown) may be included on the screeding device to measure the elevation or travel of the screed head assembly. The sensing signal may indicate the screed head position as it nears the concrete surface, and may be provided by the pair of mast mounted laser receivers mounted at upper ends of the elevation cylinders of the screed head assembly. The controls of the screeding device may initiate rotation of the screed head for raising of the vibrating device just prior to touchdown or contact of the screed head assembly to the uncured concrete in response to the sensing signal provided by the laser receivers.

Optionally, the screeding device may be operable to vibrate the vibrating member only when the screed head is being moved in the screeding direction along and over the concrete surface. If movement of the screed head is stopped, the vibrating motor or vibrating device of the vibrating member may be automatically deactivated, in order to limit or substantially preclude any depressions from occurring in the concrete surface in areas where the screed head and vibrating member may engage or rest against the concrete surface while the screed head is vibrating. When movement of the screed head commences in the screeding direction, the vibrating motor may again be activated to continue to vibrate and screed the concrete surface. Optionally, the vibrating motor may be ramped up to its operational vibration frequency as the vibrating member begins to move along the concrete surface, in order to delay the vibrator motor from reaching its full vibration speed or frequency too quickly before the vibrating member moves along the concrete surface.

Therefore, the present invention provides a concrete smoothing and leveling apparatus that has improved automatic control and is capable of finishing a concrete surface to a close-tolerance or super-flat level of quality. The apparatus and method of the present invention provides an increase in productivity while also providing improved ease of control for the machine operator. The present invention also reduces or substantially eliminates manual labor processes and their inherent variations, and may be relatively inexpensive to implement and operate over a given large-scale concrete leveling project. The present invention also contributes toward less expensive and higher quality concrete floors and surfaces.

These and other objects, advantages, purposes, and features of the present invention will become apparent upon review of the following specification in conjunction with the drawings.

DESCRIPTION OF THE PREFERRED EMBODIMENTS

Figure 1:
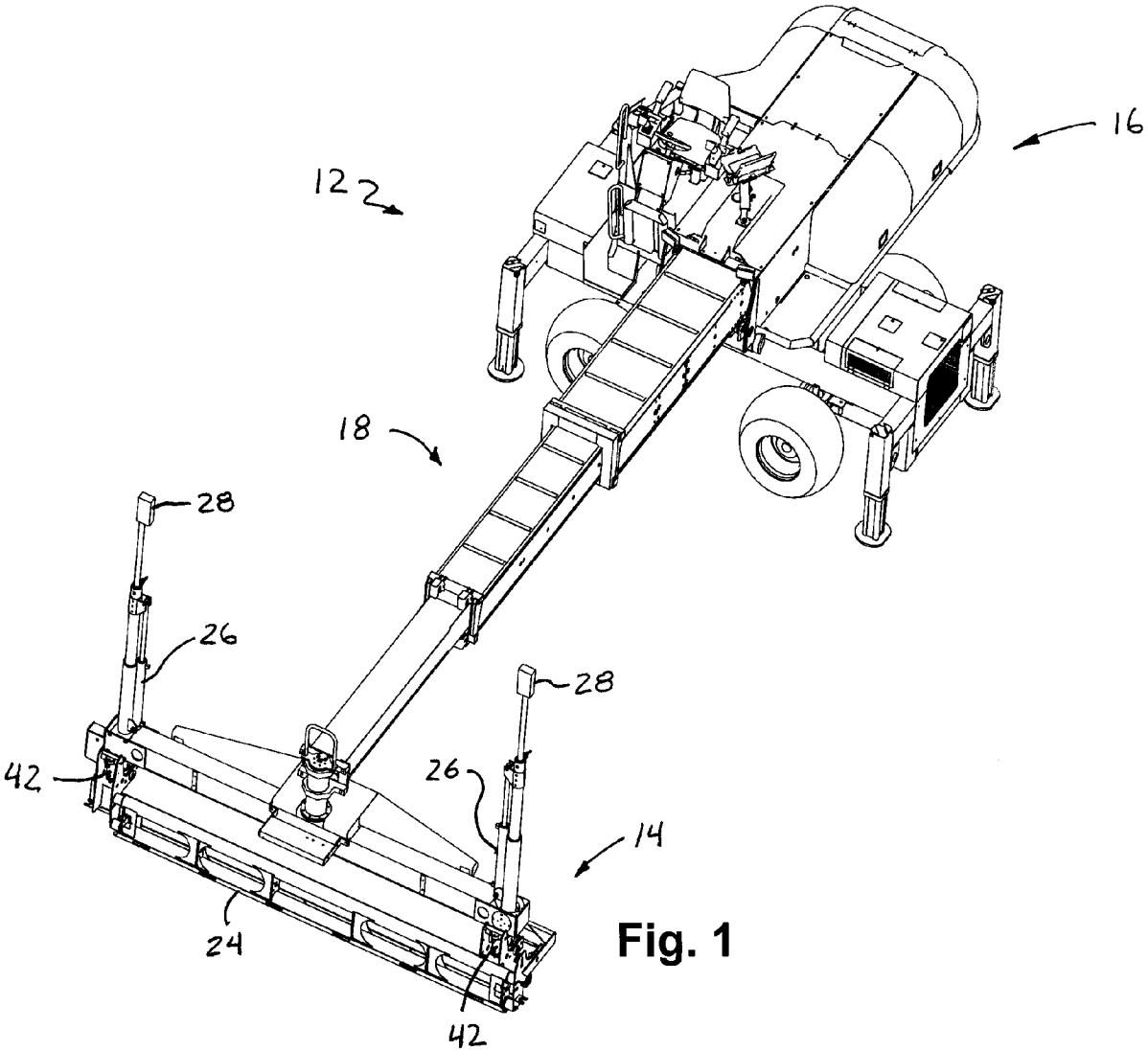
FIG. 1 is a perspective view of a concrete leveling and screeding machine that incorporates the soft landing control system of the present invention.

Referring now specifically to the drawings and the illustrative embodiments depicted therein, an automated soft landing control system 10 for a concrete screeding machine or device 12 is automatically operable to control the landing of the screed head assembly 14 onto a concrete surface (FIGS. 1 and 4A-C). Soft landing control system 10 may be applied to a concrete screeding machine to substantially improve the quality of concrete floors at overlapping or cold joint areas of the leveled and smoothed concrete. Soft landing control system 10 is operable to delay engagement of the vibrating member of the screed head assembly with the concrete surface until after the vibrating member has moved from the overlap area of already screeded concrete to an area of not yet screeded concrete, in order to reduce or substantially preclude damage or depressions or irregularities in the already screeded concrete, as discussed below.

Concrete screeding machine 12 may comprise any type of concrete screeding device or machine, such as a LASER SCREED™ screeding machine as commercially available from Somero Enterprises, LLC of Houghton, Mich., or other types of suitable concrete screeding devices or machines, without affecting the scope of the present invention. For example, screeding machine 12 may comprise a screeding machine of the types disclosed in U.S. Pat. Nos. 4,655,633; 4,930,935; and 6,227,761, which are hereby incorporated herein by reference. In the illustrated embodiment, screeding machine 12 includes a wheeled base unit 16 and an extendable boom 18 with screed head assembly 14 attached thereto. Extendable boom 18 is extendable and retractable to move screed head assembly over and along a targeted concrete surface, while screed head assembly 14 is vertically adjustable relative to boom 18 and rotatably or pivotally adjustable about a generally horizontal pivot axis 36*a*, as discussed below.

Figure 2:
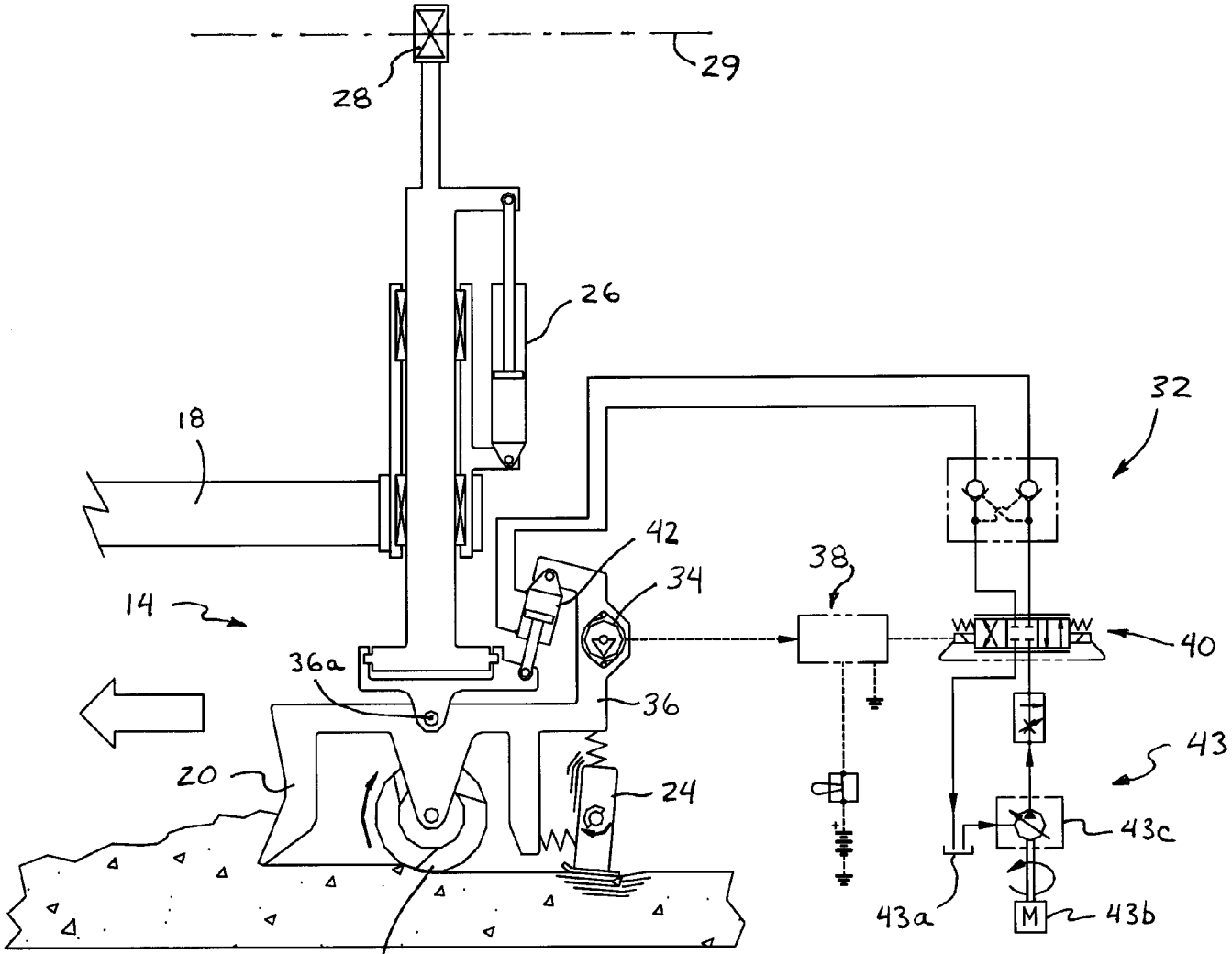
FIG. 2 is a side elevation and diagram of a concrete screed head assembly with a leveling or tilt control system.

As shown in FIG. 2, screed head assembly 14 may comprise a typical or known type of screed head assembly, and may include a plow 20, a grade setting device or auger 22 and a vibrating member 24. Screed head assembly 14 may be adjustably positioned such that auger 22 is at a desired grade via a pair of actuators or hydraulic cylinders 26, one at each end of the screed head assembly as shown in FIG. 1. The actuators 26 may be operable to raise and lower the screed head assembly in response to detection of a laser reference plane 29 by a pair of laser receivers 28 of a laser leveling system. The screed head assembly 14 may also include a screed head leveling or tilt control system 32 for adjusting the tilt or rotational position of the plow 20 and vibrating member 24 during operation of the screeding machine.

The screed head assembly leveling or tilt control system 32 (such as a system of the type disclosed by U.S. Pat. No. 4,930,935, issued to Quenzi et al. and entitled SCREEDING APPARATUS AND METHOD, which is hereby incorporated herein by reference) comprises mechanical, hydraulic, and electrical components for controlling and adjusting the angle of the plow and vibrating member. The embodiment shown in FIG. 2 is included herein as an example upon which the soft landing control system of the present invention (discussed below) may be additionally applied. Tilt control system 32 includes a level sensor 34, which is mounted to the frame 36 of screed head assembly 14, and which measures the angle or degree of tilt of the assembly about an axis of rotation 36*a* generally perpendicular to the direction of travel and generally parallel to the surface of the concrete as the screed head assembly moves over and through the uncured concrete. A controller 38 receives an input or signal from the level sensor 34. The controller 38 adjusts or controls a hydraulic valve 40 which, in turn, actuates a pair of actuators or hydraulic cylinders 42, such as one at or near each end of the screed head assembly 14, to pivot or adjust the orientation or angle of the plow 20 and vibrating member 24 about pivot axis 36*a*. Thus, the tilt control system 32 maintains the screed head assembly 14 at the desired levelness angle or tilt relative to the surface of the uncured concrete.

The actuators 26 and 42 may be hydraulic cylinders that are operable to extend and retract in response to pressurized hydraulic fluid. The screeding machine 10 may include a hydraulic system 43, which may include a fluid reservoir 43*a* and an engine or motor 43*b*, which powers a hydraulic pump 43*c* to provide pressurized fluid to the hydraulic cylinders (and any hydraulic motors of the screeding machine) via the respective control valves. However, although shown and described as having a hydraulic system for extending and retracting hydraulic cylinders, other driving means or power source may be implemented to control or adjust other actuators or the like, without affecting the scope of the present invention.

When leveling and smoothing uncured concrete with the concrete screeding machine or finishing apparatus 12, the operator must overlap the screed head assembly 14 from one smoothing pass to the next. This technique is typically necessary to obtain a continuous and uniformly level and smooth concrete surface over the entire given area as desired. This is shown by the example illustrated in FIG. 3. The crosshatched areas 44, 46 represent the overlap areas where the vibrating member 24 of the screed head assembly has engaged a smoothed and vibrated portion of concrete for the second time. The overlapping adjacent areas 44 left to right, such as between those areas overlapped by numbered screeding passes 1-2; 2-3; 3-4; 5-6; 6-7; and 7-8, present a less significant problem. This is because the concrete in these adjacent areas has not had sufficient time to settle significantly or begin the process of setting-up and curing between the successive passes of the screed head assembly.

Figure 3:
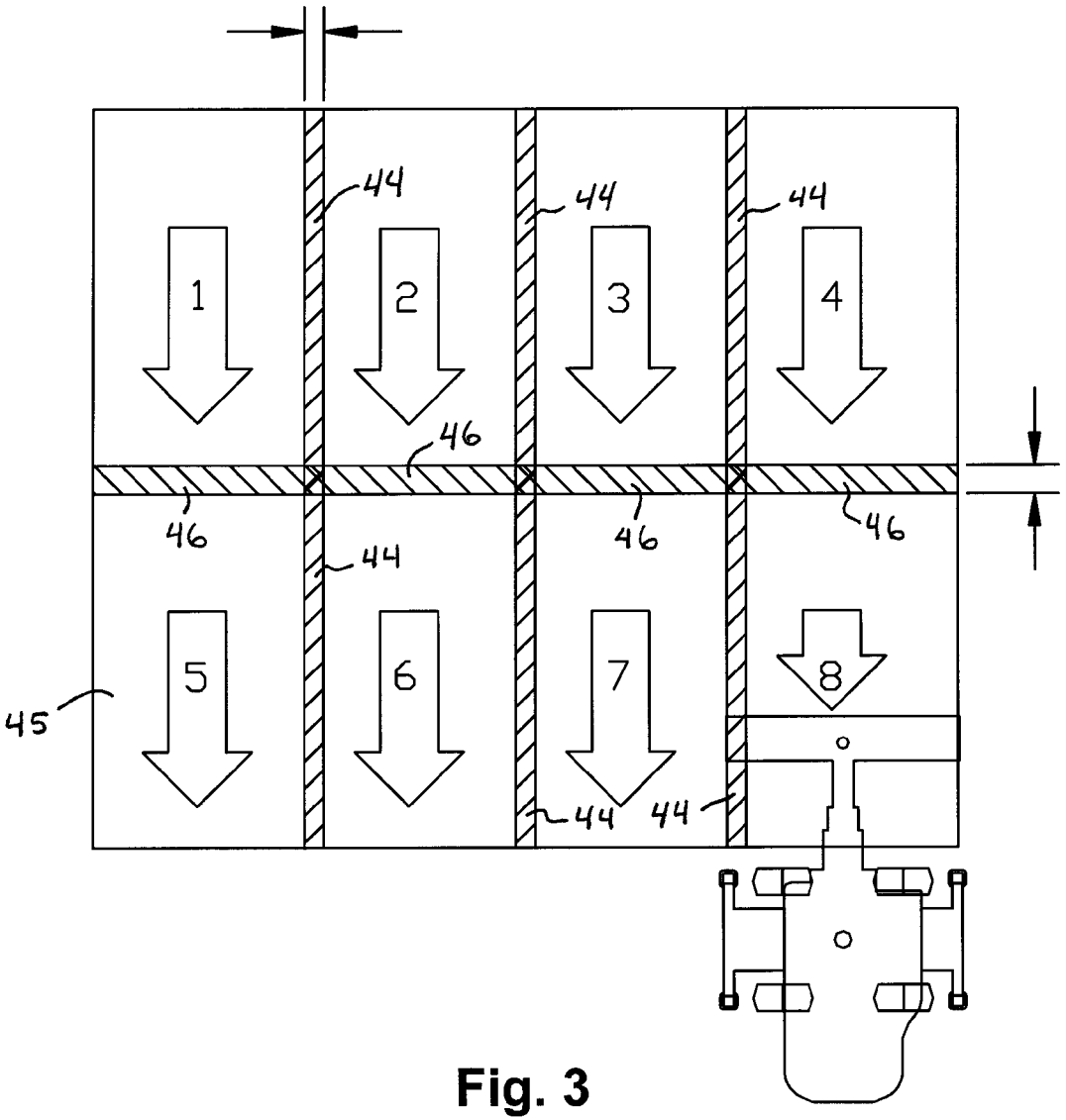
FIG. 3 is a plan view diagram representing a typical series of uncured concrete leveling and smoothing passes by a concrete screeding machine where overlapping areas typically occur between successive concrete screeding passes.

However, conditions can be quite different at the overlap areas 46 between screeding passes 1-5; 2-6; 3-7; and 4-8. When the entire first row of screeding passes is completed (e.g. passes 1 through 4 in FIG. 3), the screeding machine may be moved back to the beginning and repositioned to begin the second row of passes, such as at pass 5, in order to screed the next area of freshly placed or uncured and unscreeded concrete (referred to generally at 45 in FIG. 3). Accordingly, and as shown in FIG. 3, an area of overlap 46 may be necessary with the start of pass 5 beginning on the surface of previously screeded pass 1. In this case, the screed head assembly, including the vibrating member, is extended out and partially over the pass 1 area. Then the screed head is controllably set down and onto the surface of pass 1 to begin the screeding process for pass 5. This process is repeated for passes 6-8 with passes 1 through 4 representing areas of previously leveled and smoothed concrete. Because of the time it takes to complete passes 1 through 4, each of the passes 5 through 8 are started on smoothed concrete that has likely already at least partially set-up and cured. The illustrated application of FIG. 3 represents a simple example. However, the time delay and overlap factor becomes even more apparent when wider placements having many more passes per row are involved.

By design, the position of the vibrating member on the screed head assembly is such that the bottom surface that engages the concrete is set to a slightly angled and fixed position relative to the concrete surface. The leading edge is set just above the surface of the concrete, while the trailing edge just below the desired elevation of the finished concrete. Research and practical experience has determined that the trailing edge should typically be approximately one quarter of an inch (about 6 mm) below the desired elevation of the finished concrete to deliver best results under most conditions. Typically, the screed head assembly is positioned (such as in response to a laser leveling system) such that the auger is positioned to cut or establish the concrete surface at the desired grade, while the plow is positioned slightly above the desired grade so as to allow excess concrete to pass under the plow to the auger.

Accordingly, where the concrete has been previously screeded, such as with passes 1 through 4 in FIG. 3, and thus where the concrete has started to set-up or cure significantly, the concrete surface in the overlap areas 46 will normally not fully recover or "rebound" to the desired finished elevation upon being engaged by the vibrating member and vibrated a second time. Thus, landing depressions or troughs in the previously screeded and smoothed concrete are created by the vibrating member during the next set of passes (e.g., passes 5 through 8 in FIG. 3). These depressions or troughs typically extend the length of the vibrating member at each occurrence. The beginning of the second or subsequent row of passes (e.g. passes 5 through 8) represent the areas of concern. The slight depressions or troughs thus may be created and typically remain in the previously screeded and smoothed concrete and promote a level of imperfection in the surface quality.

Additionally, during the process of screeding, when the screed head is extended out over the concrete and then controllably set back down, the "landing" of the screed head, and in particular the vibrating member, may tend to disturb the previously screeded concrete surface. This effect is particularly noticeable when the operator has not correctly anticipated or timed the engagement of the screed head with the location of the transition between the screeded and non-screeded concrete. Smooth vertical downward movement of the screed head via the laser control system in addition to careful operator input to initiate smooth forward movement of the screed head has heretofore been necessary to reduce the effect of "poor landings".

Therefore, two types of events may cause problems for the finished surface elevation of the screeded concrete. The troughs or depressions caused by the vibrating member at the overlap areas of a series of passes, and the "poor landing" impressions created by the vibrating member as the screed head touches down onto the surface to begin another pass. Both events can tend to diminish the flatness quality or F-F number value of the concrete surface either independently or together.

When operating a concrete screeding machine it can be quite difficult to simply overcome the overlap problem by setting the screed head down (i.e. soft land the screed head) at the exact edge where the previous screeding pass ended. This is largely due to the physical structure and dimensional limitations of the screed head itself. By inherent design, and according to the direction of travel, the auger is set at a fixed distance ahead of the vibrator, and in turn, the plow is set at a fixed distance just ahead of the auger. The fixed spacing of the plow, auger and vibrating member can be reduced to a minimum through improved compact design. However, these relative dimensions are not likely to be eliminated entirely.

When attempting to match the start and stops of each screeding pass at the vibrator, some non-vibrated concrete may be left to remain just behind the auger. Similarly, some non-augured concrete may be left to remain just behind the plow. Therefore, it is impractical and very difficult for the operator to simply match the landing point of the vibrator to the exact point where the previous pass ended. This type of mismatch would typically contribute to produce an uneven and, therefore, poor-quality concrete surface. This type of mismatching is best avoided by ensuring that sufficient overlap is provided in the start and stop points of each screeding pass.

The soft landing control system of the present invention is operable to control the substantial or full engagement of the vibrator or vibrating member with the concrete surface such that such substantial engagement occurs in a smooth and controlled manner and generally at a location where the vibrator is positioned over the uncured and not previously screeded concrete 45 at or near the previously screeded or overlap area 46. The screed head assembly may be lowered toward the concrete surface with the vibrator or vibrating member raised relative to the grade setting device or auger, such that the vibrator does not substantially or fully engage the concrete surface when the auger is positioned on the concrete surface at the desired grade. The soft landing control system may lower the vibrator into substantial engagement with the concrete surface after the auger is set to the desired grade, such as in response to or following an activating event, such as a user input, a detection of the soft concrete at or near the vibrator, a detection of the screed head assembly being at a predetermined height above the desired grade and/or the like, as discussed below. Optionally, the soft landing control system may lower the vibrator into substantial engagement with the concrete surface after a period of time has elapsed following an activating event, in order to provide sufficient time for the screed head assembly and the vibrator to move over and along the concrete surface such that the vibrator will be positioned over the unscreeded concrete and generally next to or at the junction of the unscreeded concrete and the overlap area of previously screeded and partially cured concrete, as also discussed below.

Figure 4A:
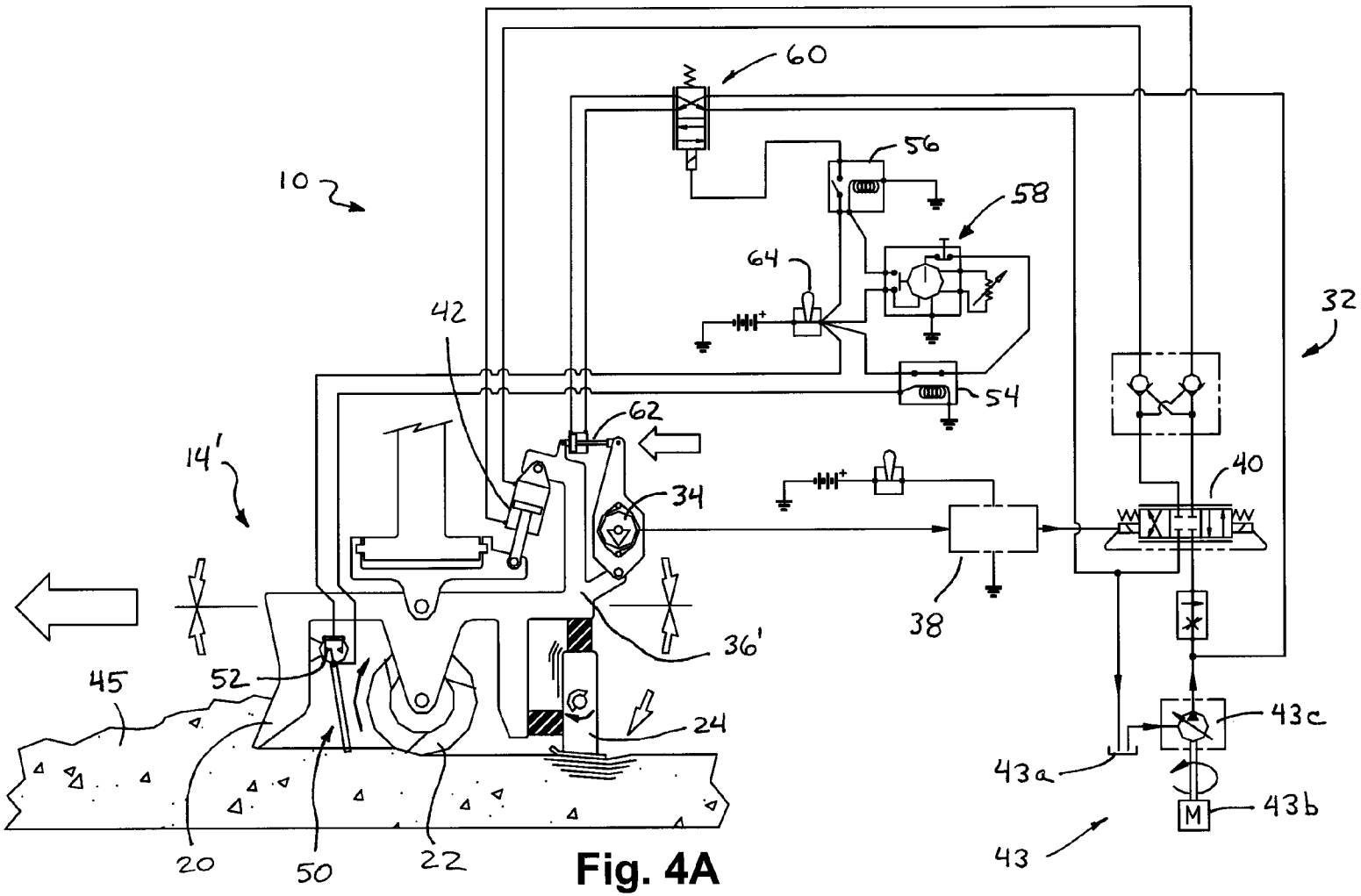
FIG. 4A is a side elevation and diagram of a soft landing control system in accordance with the present invention, with the control system in a non-activated mode.
Figure 4B:
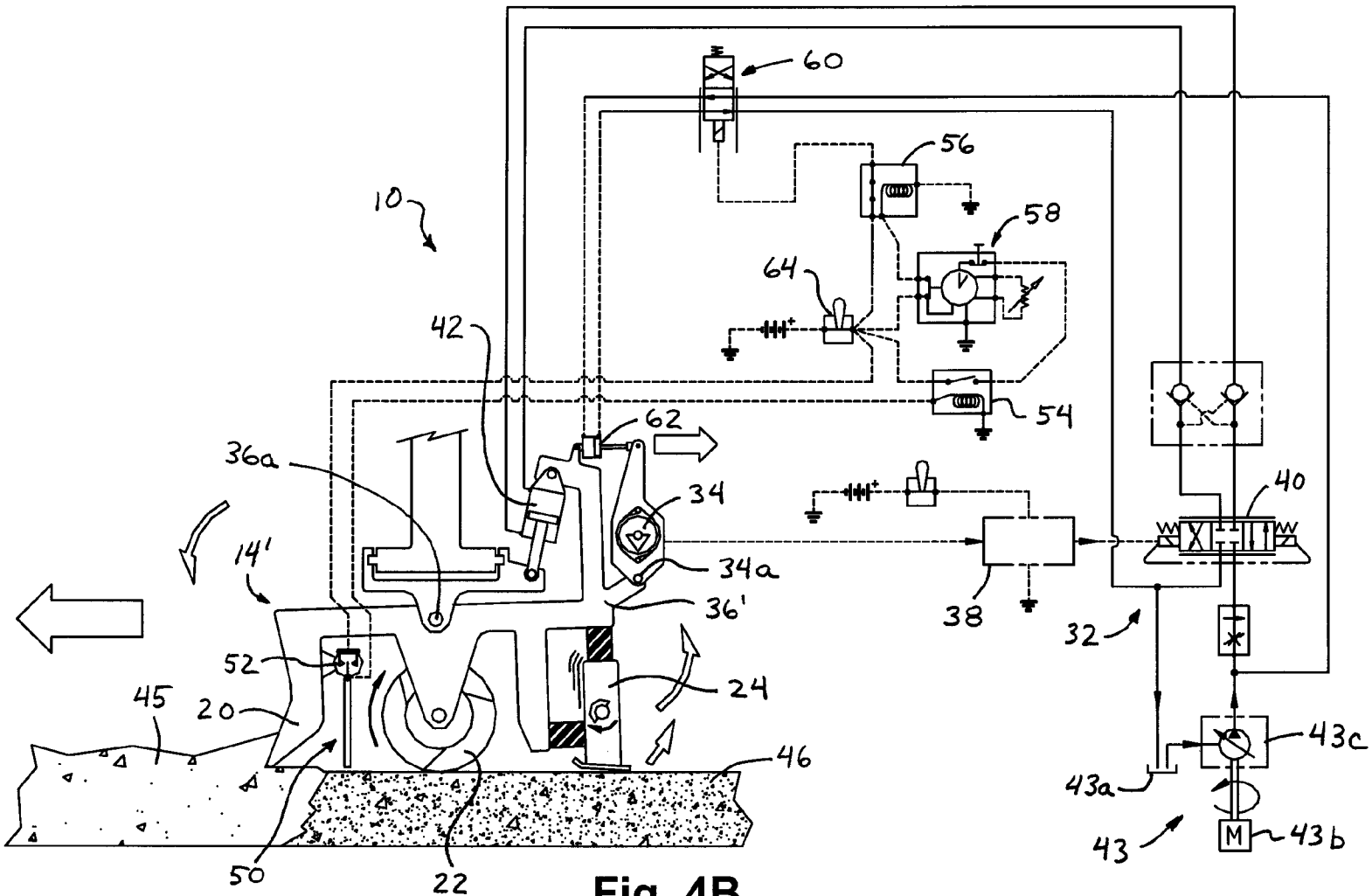
FIG. 4B is a side elevation and diagram of the control system of FIG. 4A, with the control system in a mode of temporary activation.
Figure 4C:
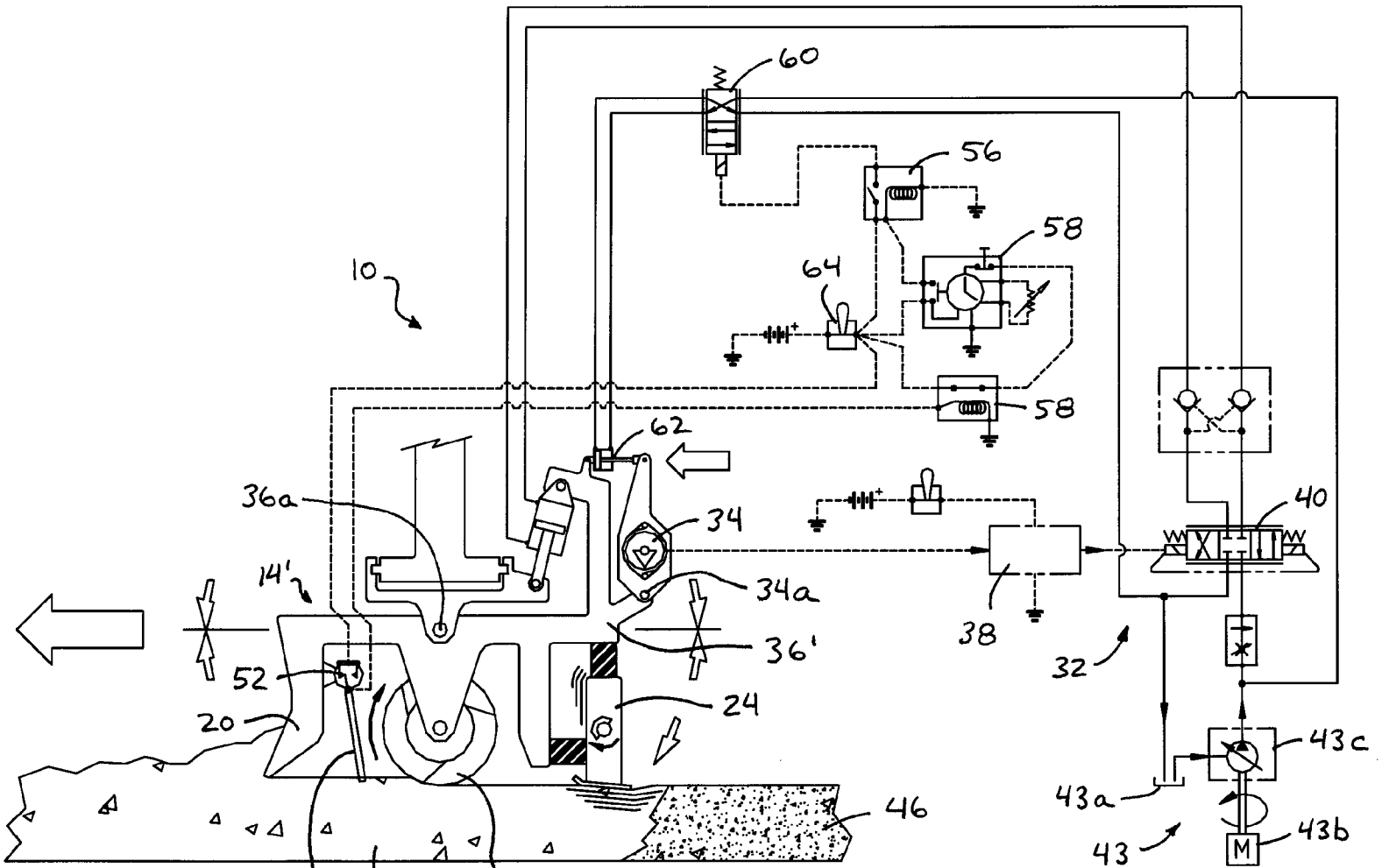
FIG. 4C is a side elevation and diagram of the control system of FIGS. 4A and 4B, with the control system returning to the non-activated mode.

Referring now to FIGS. 4A-C, soft landing control system 10 is operable to automatically control the lowering of the screed head assembly and engagement of the vibrating member with the concrete surface, particularly in the regions of overlap 46, in order to substantially reduce or minimize or eliminate troughs or depressions or other surface irregularities caused by poor landings or overlapping of the screed head assembly. Soft landing control system 10 may be added to and incorporated into the screeding device 12 and screed head assembly 14 of FIG. 2 or into other types of screed head assemblies and the like. In the illustrated embodiment of FIGS. 4A-C, soft landing control system 10 is incorporated into a screed head assembly 14' that has the level sensor 34 pivotally mounted to the frame 36' of screed head assembly 14'. Screed head assembly 14' may otherwise be substantially similar to screed head assembly 14, discussed above, such that a detailed discussion of the screed head assemblies will not be repeated herein. Soft landing control system 10 includes a wobble switch 50 (with electrical contacts 52), power relays 54, 56, a variable delay timer 58, a 4-way hydraulic valve 60, and an actuator or hydraulic cylinder 62. The small actuator 62 pivots level sensor 34 or adjusts the biasing position or the angle of the level sensor 34 of tilt/level control system 32 relative to the frame 36' of screed head assembly 14'. The actuator 62 may be extended and retracted via pressurized fluid from hydraulic pump 43*c* of hydraulic system 43, as discussed above.

As shown in FIG. 4A, soft landing control system 10 may be in a non-activated mode during normal operation of screed head assembly 14' over the surface of uncured concrete, such that vibrator 24 is substantially engaged with the concrete surface. After the screed head assembly completes a pass over the concrete surface, the screed head assembly may be raised and moved to be positioned at a starting area of a second or subsequent pass. The soft landing control system may adjust the vibrating member or screed head assembly so that the vibrating member is raised above the grade setting device prior to the screed head assembly being lowered to the concrete surface at the start of the next pass. The soft landing control system may adjust the vibrating member or screed head assembly to the initial orientation automatically, such as when the screed head is raised at the completion of the first pass or as the screed head is initially lowered toward the concrete surface at the beginning of the subsequent pass, or the vibrating member or screed head may be adjusted to the initial position in response to a user input or the like, such as an operator input as the screed head is moved toward or positioned at the start of the next pass.

When it is desired to start a new pass adjacent to an end of an already screeded area, screed head assembly 14' may be lowered down onto the concrete at the overlap area 46 where some of the concrete has already been screeded via an earlier pass of the screed head assembly 14' (as shown in FIG. 4B). A portion of the screed head assembly 14', such as the wobble switch 50, auger 22 and vibrating member 24 thus may be positioned generally over previously screeded concrete 46, such that wobble switch 50 does not engage any unscreeded concrete that is above the grade of the concrete surface. When the screed head assembly 14' is to be lowered down into engagement with the concrete surface, soft landing control system 10 may be selectively or automatically set to the initial position or set to a mode of temporary activation, such that screed head assembly 14' is pivoted to initially raise vibrator 24 above the concrete surface or slightly contacting the concrete surface when the auger 22 is positioned generally at the grade level, as shown in FIG. 4B. Optionally, soft landing control system 10 may be initially activated via actuation of a user input or switch or button 64, which may be positioned at the controls of the screeding machine 12 for actuation by the operator of the screeding machine. In the activated mode, open contacts 52 (as shown in FIG. 4B) within the wobble switch 50 may result from no excess concrete passing under the plow (because the wobble switch is initially positioned over the previously screeded concrete 46). The primary relay 54 is thus open. However, the delay timer 58 maintains power to the secondary relay 56 and the 4-way hydraulic directional valve 60. This enables the small hydraulic cylinder 62 to extend to adjust the level sensor 34 bias position (via pivoting the sensor 34 relative to frame 36' about a pivot axis 34*a*). Tilt control system 32 thus will pivot screed head assembly 14' about pivot axis 36*a* to reposition level sensor 34 to its initial or normal operation orientation and, thus, to maintain the screed head in the counterclockwise rotated position shown in FIG. 4B. The vibrating member 24 is thus temporarily lifted upward from the previously screeded and somewhat firm concrete surface so as to avoid engaging and depressing the previously screeded concrete surface when the screed head assembly is lowered to the concrete surface.

With reference to FIG. 4C, soft landing control system 10 may return to a non-activated mode after the screed head assembly 14' is moved past the overlap area 46. More particularly, as screed head assembly 14' is moved over the not yet screeded concrete 45, wobble switch 50 will again engage concrete that passes under the plow 20 and will pivot to close the contacts 52 of the switch. The soft landing control system 10 may be operable to lower or delay lowering the vibrating member in response to the activating event or closure of the contacts 52. As shown in FIG. 4C, the primary relay 54 is then closed and the delay timer 58 functions to delay the opening of the circuit at secondary relay 56 for a predetermined period of time, such that the actuator 62 remains extended and the vibrator 24 thus remains raised for the predetermined period of time. The selected time that the delay timer 58 is set to may be selected to provide enough time for the screed head assembly to move along the concrete surface until the vibrating member 24 (which is initially raised above the concrete surface due to the pivoting of the screed head assembly as discussed above with respect to FIG. 4B) is positioned generally over the uncured concrete 45, and thus may be selected or set depending on the speed that the screed head assembly may move along the concrete or on the operator's preference or other characteristics. The desired time delay may be selected by the operator or may be otherwise set or adjusted as desired, without affecting the scope of the present invention.

After the delay period, the delay timer 58 resets to open the circuit to the secondary relay 56 and 4-way hydraulic valve 60. The 4-way hydraulic valve 60 and the small hydraulic cylinder 62 thus return to their initial or normal positions, thereby returning the level sensor 34 to its normal position, such that tilt control system 32 may pivot or adjust screed head assembly 14 and vibrating member 24 to their normal operating positions, with vibrating member 24 being lowered to substantially engage the concrete surface as shown in FIG. 4C. The soft landing control system may slowly and smoothly lower the vibrator into substantial engagement with the concrete surface after the time delay. Rotation of the screed head assembly 14 (such as in the clockwise direction in FIGS. 4A-C) and engagement of the vibrating member 24 with the concrete surface is thus adjustably timed to occur smoothly near the transition or junction or cold joint between the previously screeded and somewhat firm concrete area 46 to the soft unscreeded concrete area 45 as the screed head assembly 14 moves steadily forward over and along the concrete surface.

As shown in FIGS. 5-12 and as discussed below, various embodiments of the soft landing control system of the present invention may be implemented with a screed head assembly or screeding device or machine to automatically control the engagement of the vibrating member with the concrete surface to substantially preclude engagement with the previously screeded overlap areas, in order to enhance the flatness and quality of the concrete surface being screeded. The embodiments discussed herein may share some similar components and functions/characteristics, with the similar components being referenced in the drawings and the below discussion with the same or similar reference numbers as shown in FIGS. 4A-C and in the above discussion. The embodiments discussed herein are exemplary of the soft landing control system of the present invention, and the present invention is not to be limited to the specifically described embodiments.

Figure 5A:
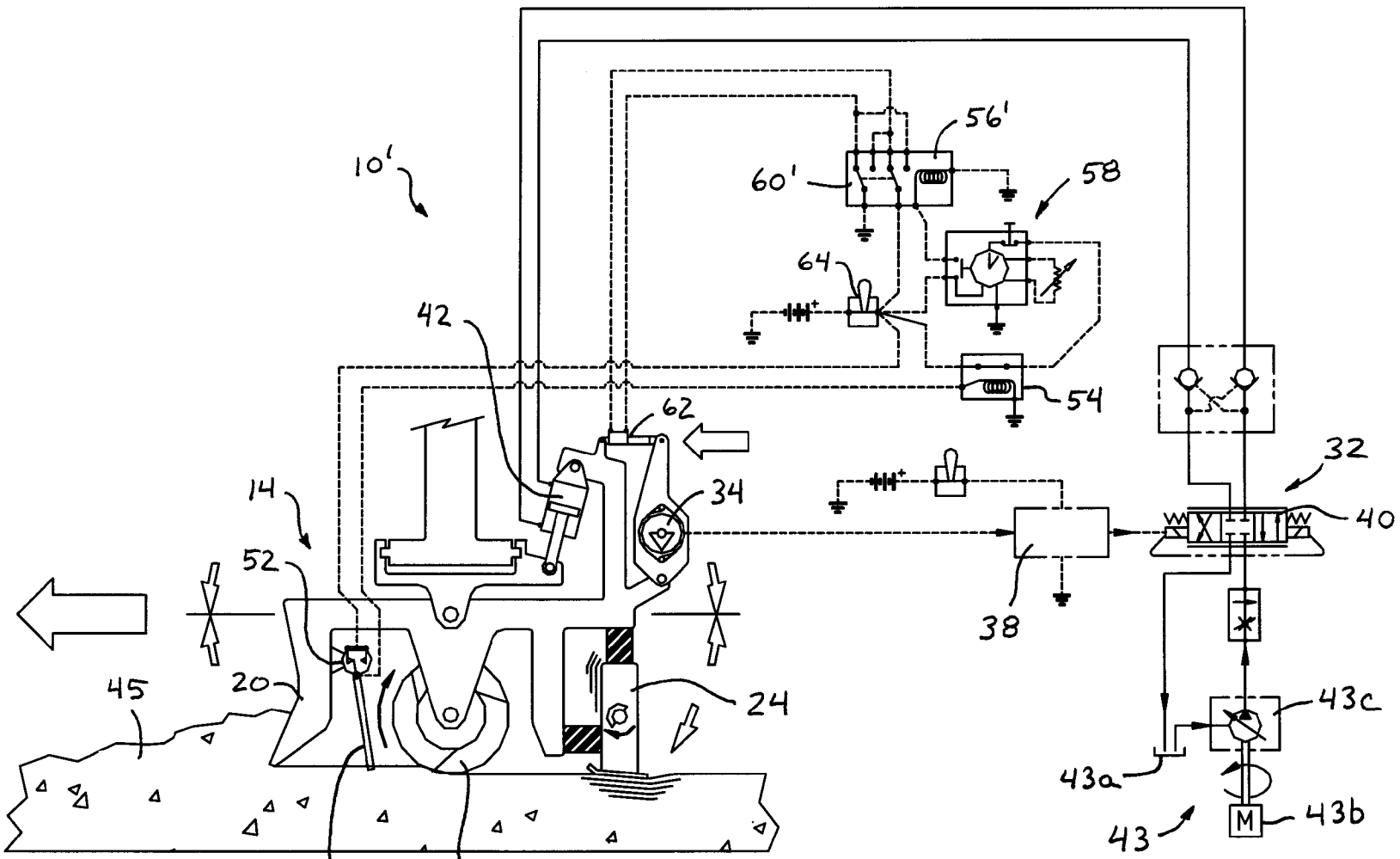
FIG. 5A is a side elevation and diagram of another soft landing control system of the present invention, shown in a non-activated mode.
Figure 5B:
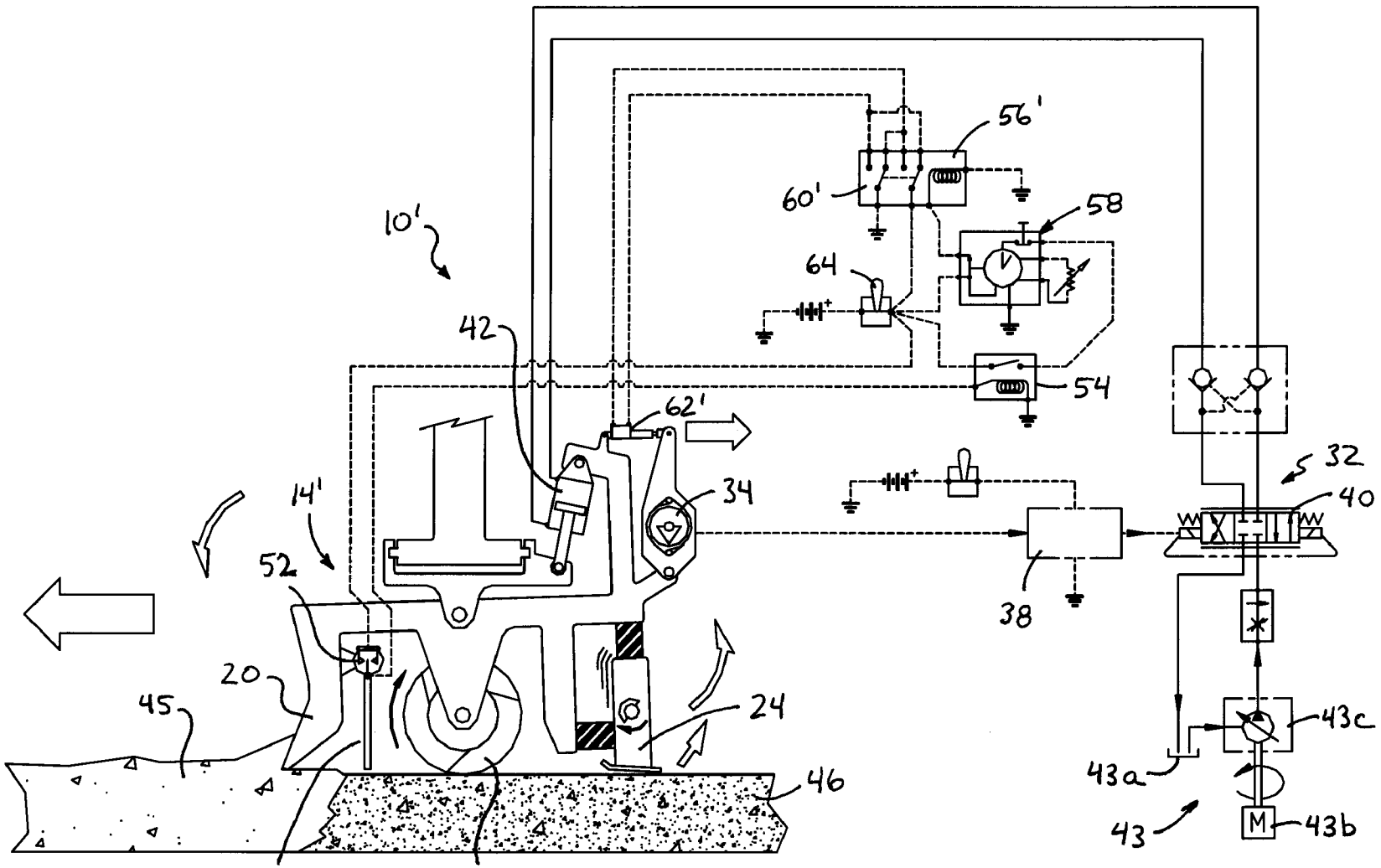
FIG. 5B is a side elevation and diagram of the control system of FIG. 5A, shown in a mode of temporary activation.
Figure 5C:
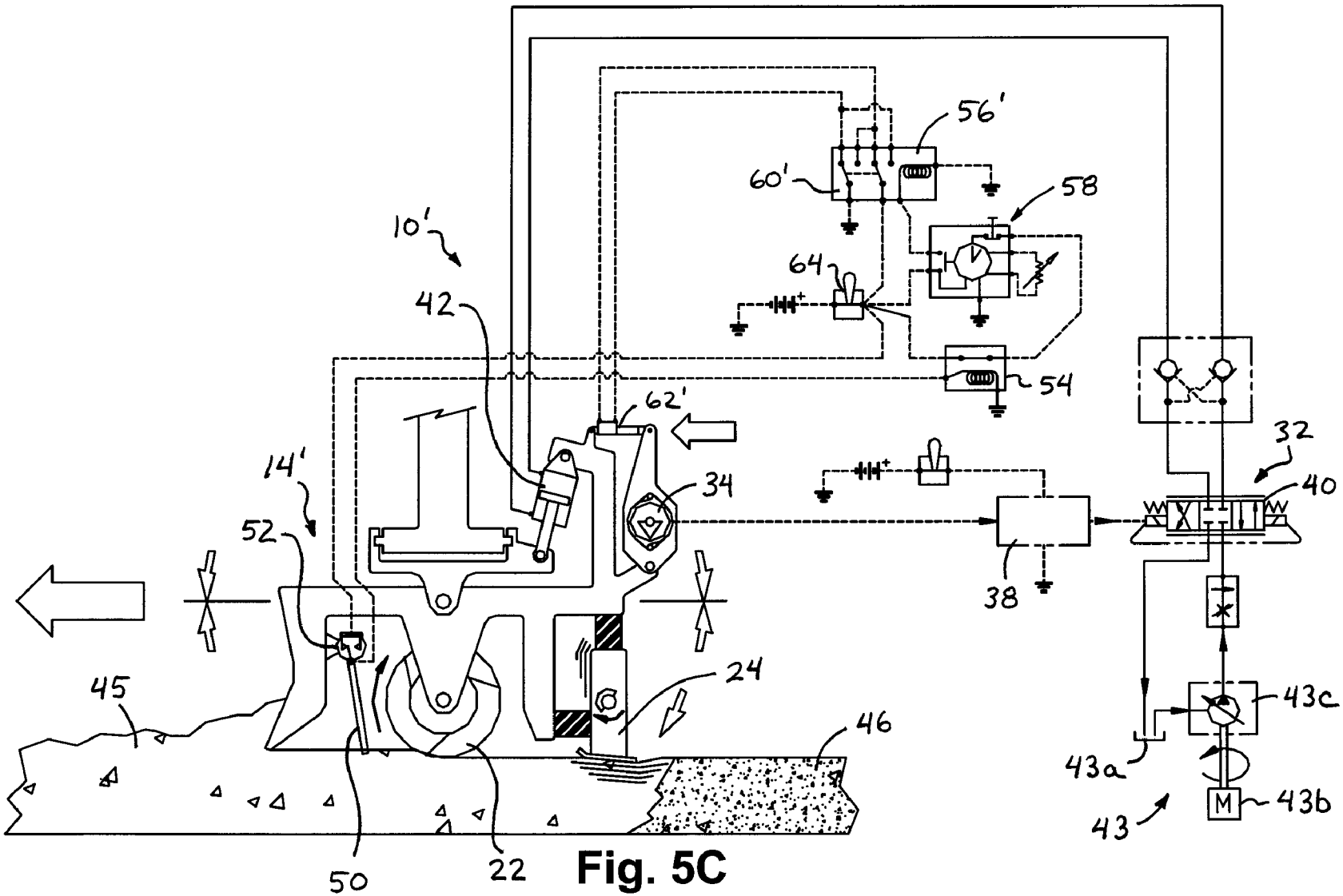
FIG. 5C is a side elevation and diagram of the central system of FIGS. 5A and 5B, shown with the vibrating member moved into substantial engagement with the uncured concrete.

With reference to FIGS. 5A-C, another soft landing control system 10' of the present invention is shown incorporated into screed head assembly 14'. Soft landing control system 10' is substantially similar to soft landing control system 10, discussed above, except that an electric linear actuator 62' replaces the small hydraulic cylinder 62 of soft landing control system 10. Likewise, secondary relay 56 and control valve 60 are replaced by a secondary relay 56' and electric switch 60', which function to actuate linear actuator 62' in a similar manner as described above. As shown in FIG. 5A, the linear actuator may be retracted during normal operation of screed head assembly 10', such that vibrating member 24 is substantially engaged with the concrete surface to vibrate and screed the concrete surface as the screed head assembly 14' is moved over the concrete surface. As shown in FIG. 5B, the soft landing control system 10' may be set to a mode of temporary activation, such as automatically or via a user input 64 or the like. As the screed head assembly 14' is lowered onto the overlap area 46, the open contacts 52 within the wobble switch 50 result from a lack of engagement with a normal excess of concrete passing under the cutting edge of the plow, such that the primary relay 54 is open. However, the delay timer 58 maintains power to the secondary relay 56', keeping the electric linear actuator 62' extended, and thus maintaining the screed head at a counterclockwise rotated position (as shown in FIG. 5B), and thus raising the vibrating member 24 above the concrete surface at the overlap area 46.

As the screed head assembly moves forward (to the left in FIGS. 5A-C), the wobble switch 50 again engages fresh concrete passing under the plow 20 and the contacts 52 of the wobble switch 50 close and thus energize the delay timer 58. After the delay period as set by the delay timer, the switch 60' retracts actuator 62' and tilt control system 32 rotates the screed head assembly and vibrating member (such as in the clockwise direction in FIG. 5C) to move vibrating member 24 into engagement with the concrete surface after the screed head assembly has moved past the overlap area 46. Clockwise rotation of the screed head and engagement of the vibrating member with the concrete surface are thus adjustably timed to occur smoothly near the transition from the previously screeded and somewhat firm concrete 46 to the soft unscreeded concrete 45 as the screed head assembly moves steadily forward over and along the concrete surface.

Figure 6A:
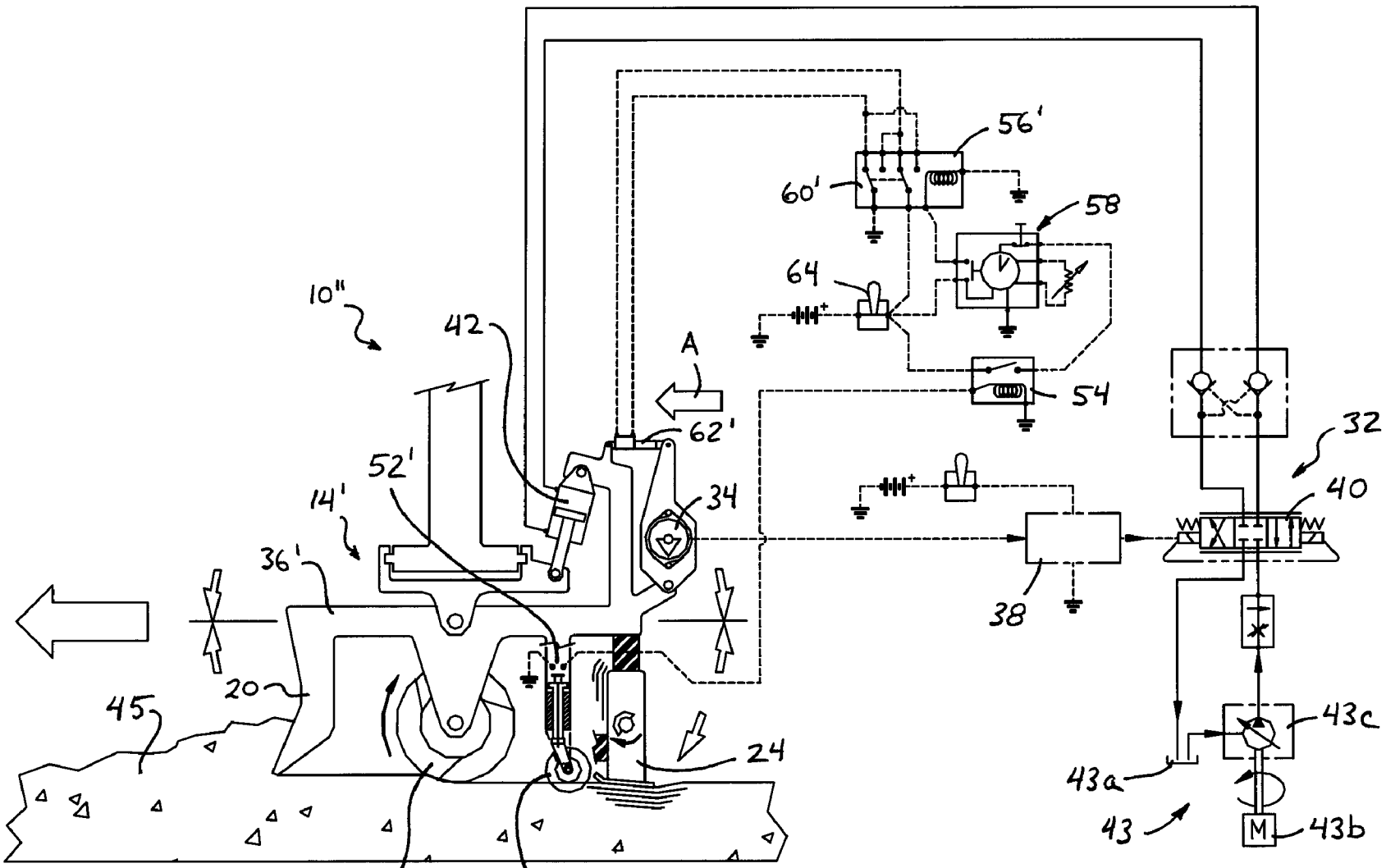
FIG. 6A is a side elevation and diagram of another soft landing control system of the present invention, shown in a non-activated mode.
Figure 6B:
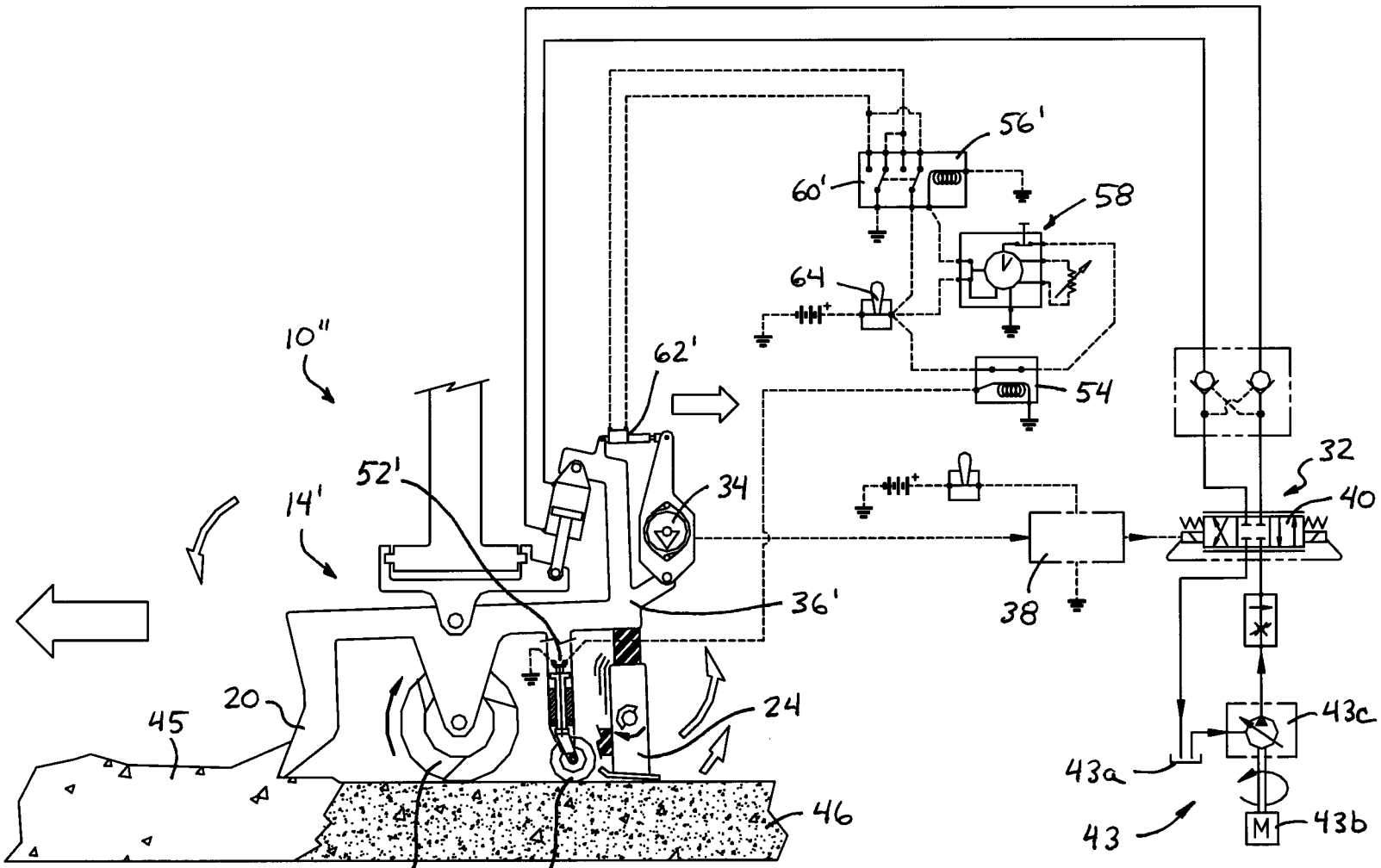
FIG. 6B is a side elevation and diagram of the control system of FIG. 6A, shown in a mode of temporary activation
Figure 6C:
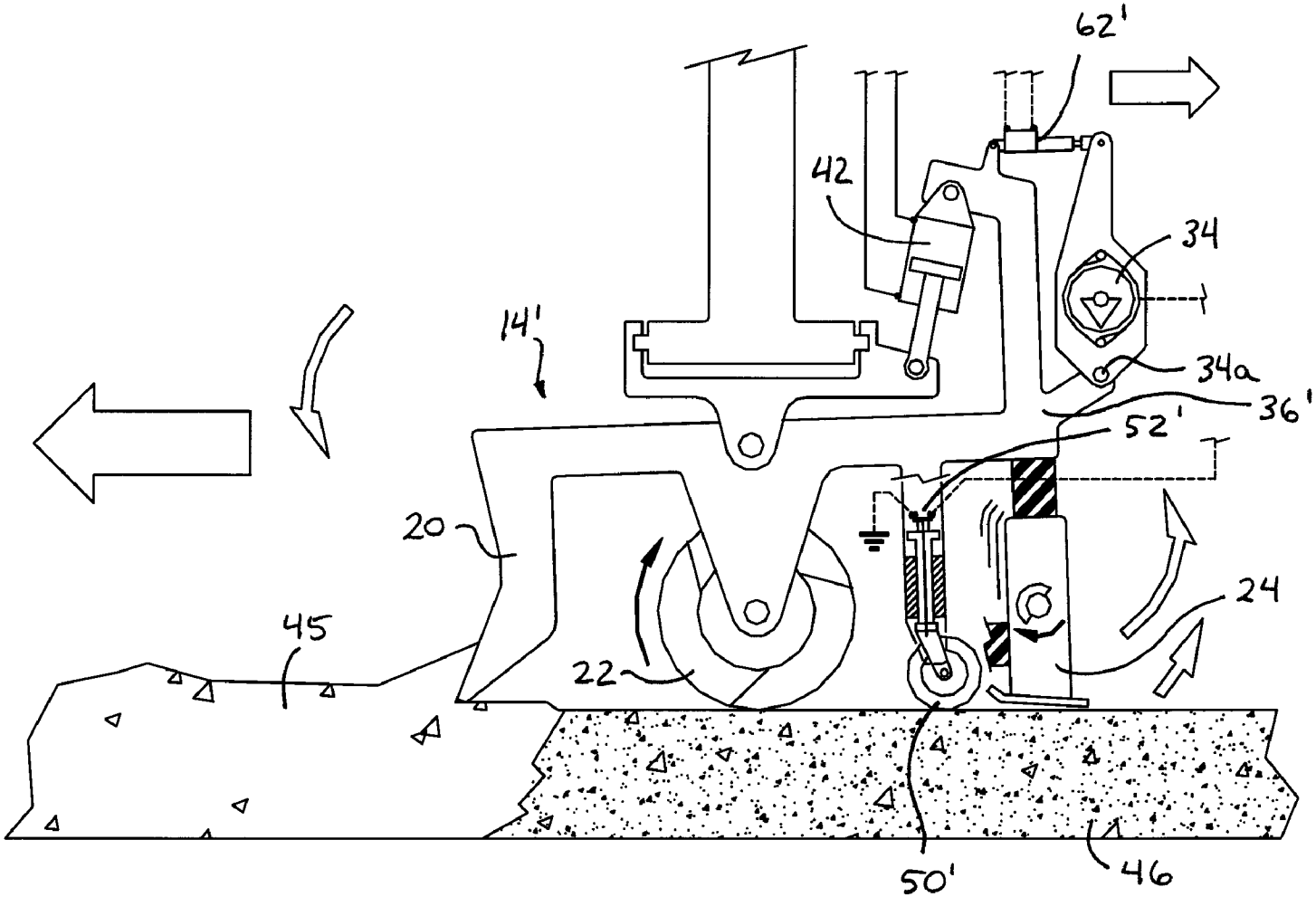
FIG. 6C is an enlarged view of a portion of FIG. 6B.
Figures 6D, 6E, 6F, 6G, 6H, 6I:
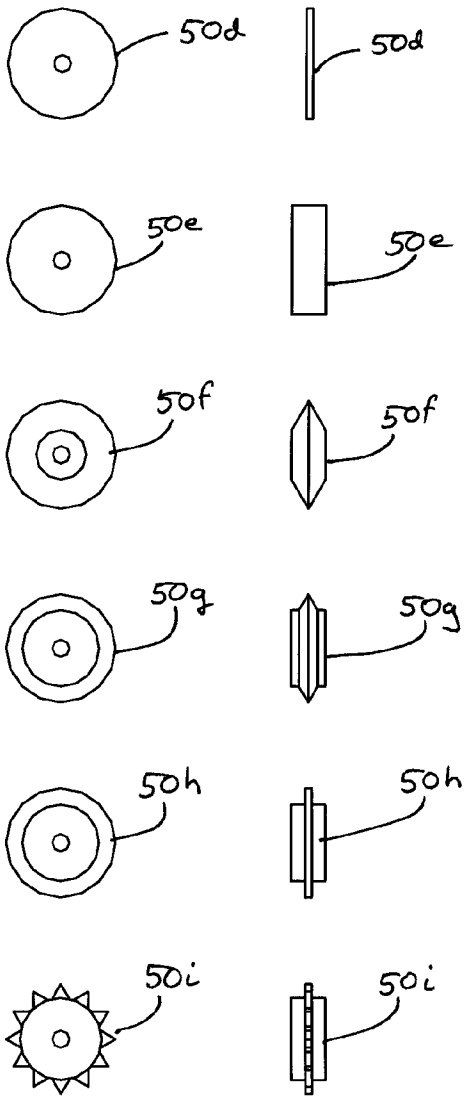
FIGS. 6D-I represent various designs of the concrete sensor wheels that may be interchangeably used with the control system of FIGS. 6A and 6B.

Referring now to FIGS. 6A-C, another soft landing control system 10" of the present invention is shown incorporated into screed head assembly 14'. Soft landing control system 10" is substantially similar to soft landing control system 10', discussed above, except that a concrete sensing wheel 50' replaces the wobble switch 50 of soft landing control system 10'. Concrete sensing wheel 50' is vertically movable relative to the frame 36' of screed head assembly, whereby movement of the wheel relative to the frame 36' actuates a wheel switch 52'. The wheel 50' either rolls upon the surface of the concrete (such as on the surface of the already screeded overlap area 46 as shown in FIGS. 6B and 6C) or at least partially sinks into the concrete (such as into the newly placed concrete 45 as shown in FIG. 6A). Downward movement of the wheel thus may occur when the wheel moves from the already screeded and at least partially cured and somewhat firm overlap area 46 onto the newly placed soft concrete area 45 and partially sinks into the concrete, whereby such movement of the wheel accordingly opens wheel switch 52' to actuate or initiate the soft landing process, as discussed below.

As shown in FIG. 6A, soft landing control system 10" may be in a non-activated mode during normal operation of the screed head assembly. When the screed head assembly is lowered onto the concrete surface at the beginning of a pass and at the overlap area 46 (as shown in FIGS. 6B and 6C), soft landing control system 10" may be operable in a mode of temporary activation, such as automatically or in response to actuation of a switch or other user input 64. When the sensing wheel 50' is rolling over the previously screeded and partially cured concrete area 46 (as shown in FIGS. 6B and 6C), the wheel 50' closes the switch 52'. The closed contacts within the wheel switch 52' result from the concrete sensing wheel being supported by the previously screeded and somewhat firm concrete. In such a situation, the primary relay 54 is closed with power supplied through the delay timer 58 to the secondary relay 56, such that the switch 60' actuates and extends the electric linear actuator 62'. The tilt control system 32 thus pivots or moves or adjusts the screed head assembly 14' to move and maintain the level sensor 34 to its bias position, and thus maintain the screed head in its rotated position (such as in the counterclockwise direction in FIGS. 6B and 6C). Thus, the vibrating member 24 is temporarily lifted upward from the previously screeded and somewhat firm concrete surface area 46 so as to not substantially engage the concrete surface.

As the screed head assembly 14' moves forward, the sensing wheel 50' may move onto and sink into the freshly placed, less firm, soft concrete area 45, thereby opening the contacts within the wheel switch 52' and thus opening the contacts of the primary relay 54. The delay timer 58 then maintains power to the secondary relay 56' and linear actuator 60' for a short period of time (as set or selected as discussed above) to temporarily avoid actuation of linear actuator 62'. After the time period has elapsed, the linear actuator 62' may be retracted via switch 60', such that level sensor 34 pivots in the direction of the arrow A in FIG. 6A, whereby the tilt control system 32 may adjust or pivot the screed head assembly 14' to lower the vibrating member 24 to engage the concrete surface (such as via clockwise rotation in FIG. 6A). Such rotation of the screed head and engagement of the vibrating member 24 with the concrete surface is thus adjustably timed to occur smoothly near the transition from the previously screeded and somewhat firm concrete 46 to the soft unscreeded concrete 45 as the screed head assembly continues steady forward movement.

Concrete sensing wheel 50' may comprise a circular wheel or disc of any form, without affecting the scope of the present invention. For example, and with reference to FIGS. 6D-I, various designs of concrete sensor wheels may be selected or interchangeably used with the screed head assembly shown in FIGS. 6A and 6B. The concrete sensing wheels 50*d-i* of FIGS. 6D-I, respectively, have various cross section profiles that offer different contact characteristics with the concrete, such as narrow profiles (wheels 50*d*, 50*g*, 50*h* and 50*i*), wide profiles (wheel 50*e*), smooth profiles (wheels 50*e-h*) or even uneven profiles (wheel 50*i*) or the like. The various wheel profiles may be selected based upon the general concrete slump and mix design characteristics of the uncured concrete, as well as the prevailing site conditions, in order to enhance the performance of the sensing wheel and, thus, of the soft landing control system. For example, a narrow edge or uneven profile may be desired in applications where the concrete may be firmer or more resistant to depressions even when in the uncured and unscreeded state.

Figure 7A:
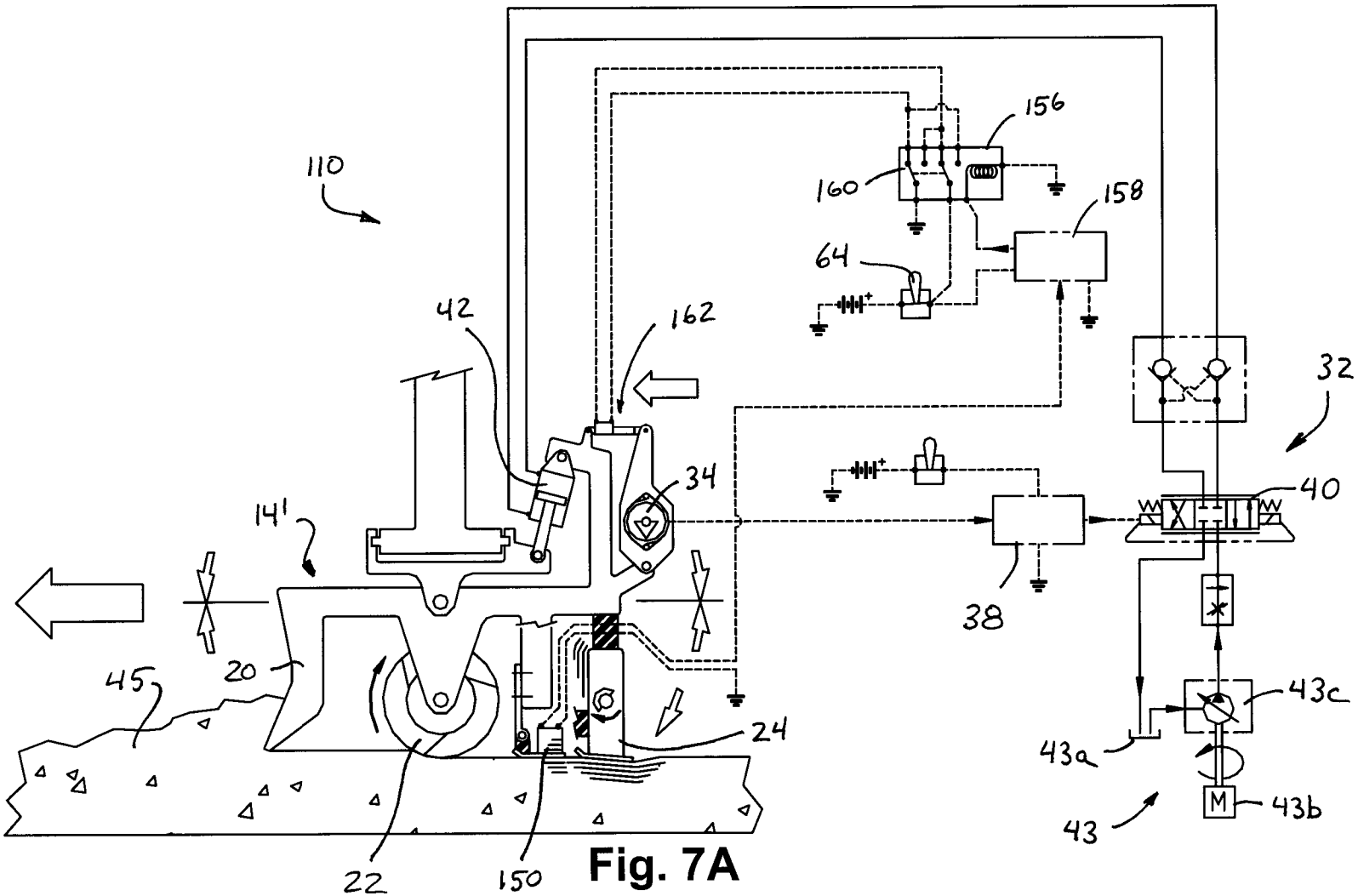
FIG. 7A is a side elevation and diagram of another soft landing control system of the present invention, shown in a non-activated mode and having a vibration sensor.
Figure 7B:
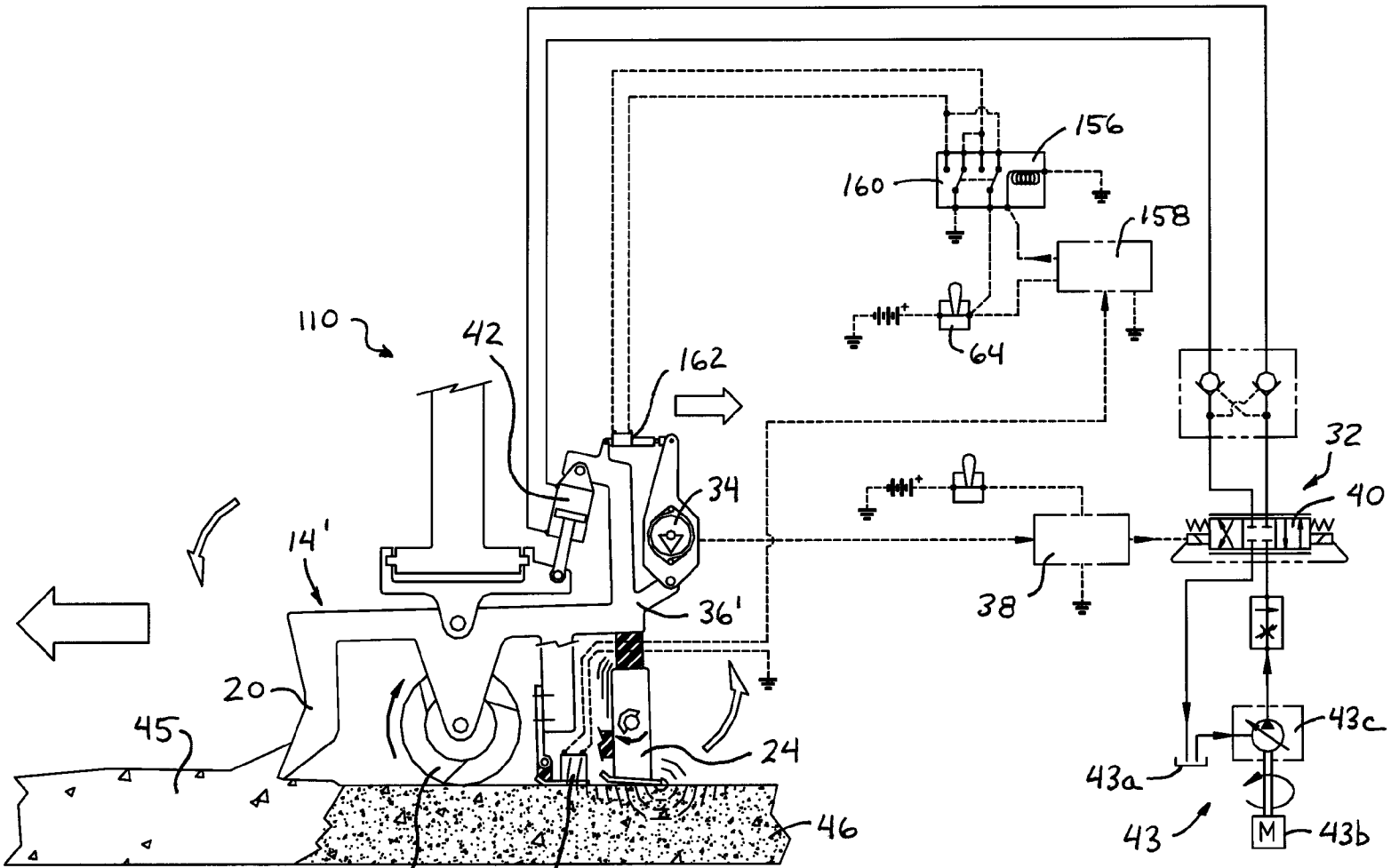
FIG. 7B is a side elevation and diagram of the control system of FIG. 7A, shown in an activated mode.
Figure 7C:
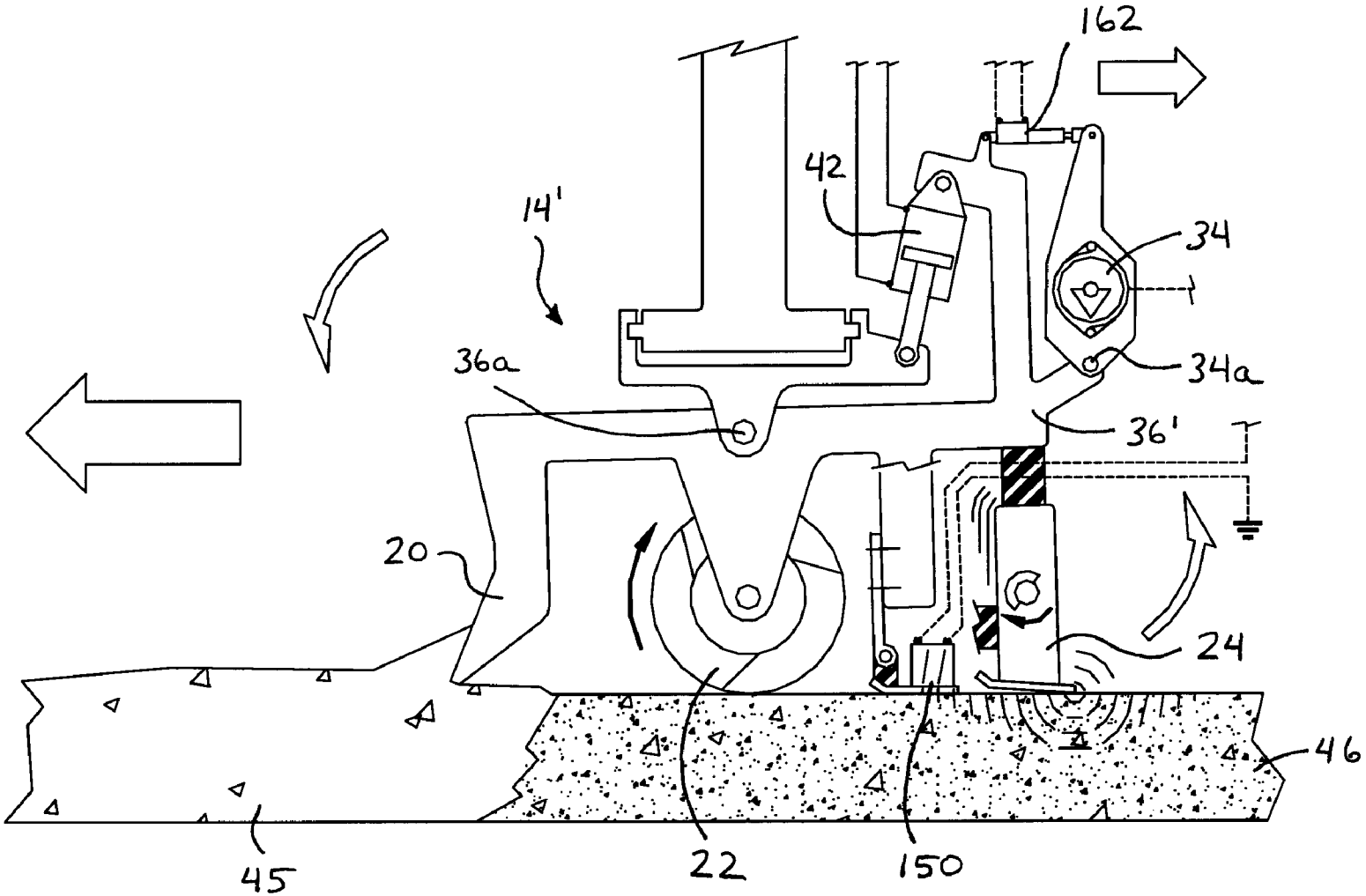
FIG. 7C is an enlarged view of a portion of FIG. 7B.

Referring now to FIGS. 7A-C, another soft landing control system 110 is shown incorporated into screed head assembly 14'. Soft landing control system 110 includes a vibration sensor or accelerometer 150 that is located adjacent to the vibrator or vibrating member 24 and is able to detect either soft or somewhat firm concrete under the vibrating member via measurement of the level of vibration transferred within the concrete between the vibrating member 24 and the vibration sensor 150. Soft landing system 110 includes a controller 158 that receives a signal from the vibration sensor 150 and that controls a relay 156 and switch 160 in response to the signal. The switch 160 then may extend or retract the linear actuator 162 in response to relay 156, such as in a similar manner as described above.

As shown in FIG. 7A, the relay 156 may be open such that linear actuator 162 is retracted during normal operation of the screed head assembly 14' as screed head assembly 14' is moved over and along the uncured concrete. The soft landing control system 110 may be operable in an activated mode (such as automatically or via actuation of a user input or switch 64) when the screed head assembly 14' is lowered onto an overlap area 46 where the concrete has been previously screeded and partially set up or cured (as shown in FIGS. 7B and 7C). The vibration sensor or accelerometer 150 is operable to detect a change in firmness of the concrete under the vibration sensor 150 as the vibration sensor 150 moves over the concrete surface. The vibrating sensor 150 may include or be associated with a separate vibrating device that may contact the concrete surface or may detect the vibration in the concrete from a partial contact of the concrete surface with the vibrating member 24 (such as shown in FIGS. 7B and 7C).

The controller receives the signal from the vibrating sensor 150 and energizes the linear actuator relay 156 to connect or close switch 160 to extend linear actuator 162 in response to a detection of firm concrete that is indicative of the previously screeded and partially cured area 46. With the linear actuator 162 extended, the level sensor 34 is set to its bias position, such that tilt control system 32 pivots screed head assembly 14' and maintains the screed head in the counterclockwise rotated position shown in FIGS. 7B and 7C. Thus, the vibrating member 24 is temporarily lifted upward from the previously screeded and somewhat firm concrete surface area 46. As can be seen in FIGS. 7B and 7C, vibrator 24 may partially or slightly contact the concrete surface to impart vibration thereto for sensing by the vibration sensor 150.

As the screed head assembly 14' continues to move forward (or to the left in FIGS. 7B and 7C), the vibration sensor 150 engages the freshly placed and uncured and softer concrete area 45. The vibration sensor 150 detects the vibration through the uncured concrete and the controller 158 detects the change in vibration and reverses the output of the linear actuator relay 156 to change the switch 160. The linear actuator 162 is thus retracted to return the level sensor 34 to its normal operating position, such that actuators 42 of tilt control system 32 pivot screed head assembly 14 (such as in the clockwise direction in FIGS. 7A-C) to move vibrating member 24 into substantial or full engagement with the softer concrete.

Optionally, controller 158 may include a timing device or mechanism (not shown) and thus may delay the rotation of the screed head (in the clockwise direction in FIGS. 7A-C) after detection of the softer concrete, such that the vibrating member 24 will not be moved or lowered into substantial engagement with the concrete surface until after it has moved further over and along the surface to be generally at the softer concrete area. Clockwise rotation of the screed head and substantial engagement of the vibrating member with the concrete surface thus may be adjustably timed by the controller to occur smoothly near the transition from the previously screeded and somewhat firm concrete 46 to the soft unscreeded concrete 45 as the screed head continues steady forward movement.

Figure 7D:
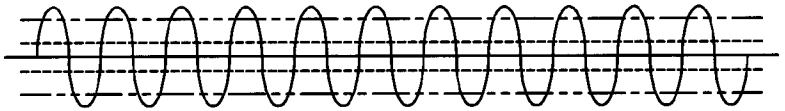
FIGS. 7D-G are representations of the relative levels of vibration measured or sensed by the vibration sensor shown in FIGS. 7A-C.
Figure 7E:
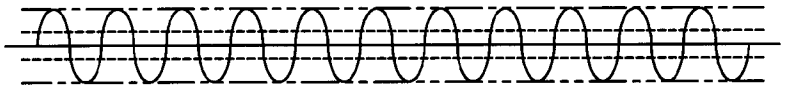
Figure 7F:
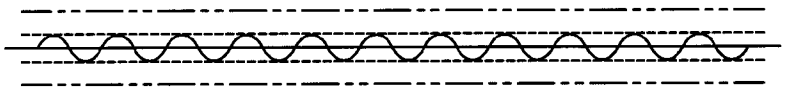
Figure 7G:
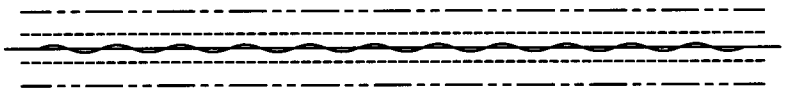

As shown in FIGS. 7D-G, different levels of vibration may be measured or sensed by the vibration sensor or accelerometer. FIGS. 7D-G are exemplary representations of the relative levels of vibration measured or sensed by the vibration sensor or accelerometer of soft landing control system 110. For example, FIG. 7D represents the vibration where the condition of the uncured concrete is substantially soft and not vibrated or screeded, while FIG. 7E represents the vibration where the condition of the uncured concrete may be recently vibrated, and FIG. 7F represents the vibration where the condition of the uncured concrete is previously vibrated and somewhat firm, and FIG. 7G represents the vibration where the condition of the uncured concrete is previously vibrated and substantially firm, such as may be expected at the overlap areas 46 or the like. The controller may be programmed or set to recognize the different vibrations and to adjust or rotate the screed head assembly or lower the vibrator or vibrating member in response to detection and recognition of a particular type of vibration, depending on the type of concrete and/or other parameters or characteristics of the particular application of the screeding machine.

Figure 8A:
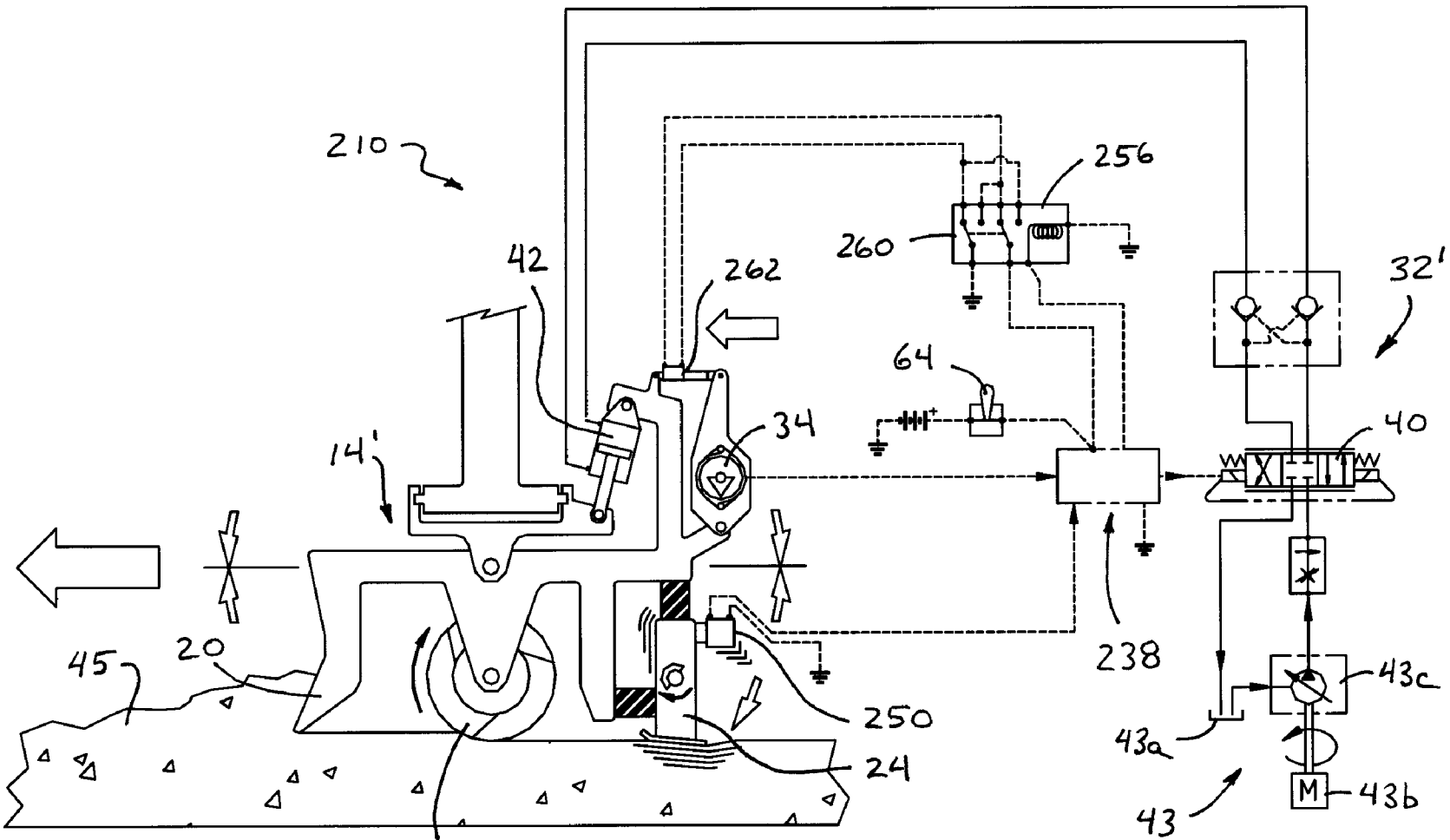
FIG. 8A is a side elevation and diagram of another soft landing control system of the present invention, shown in a non-activated mode.
Figure 8B:
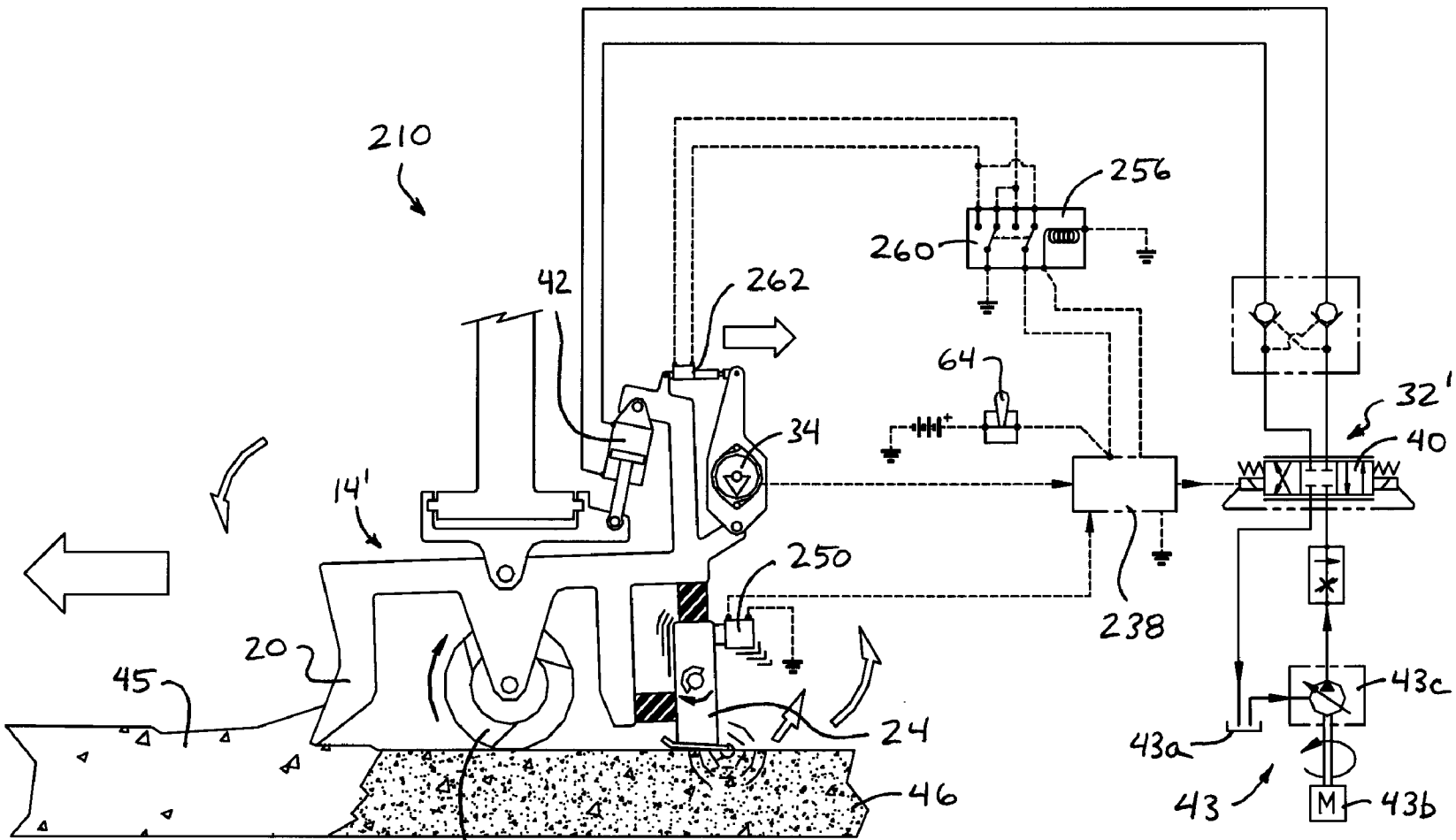
FIG. 8B is a side elevation and diagram of the control system of FIG. 8A, shown in an activated mode.

Referring now to FIGS. 8A and 8B, a soft landing control system 210 is incorporated into the controller 238 of a tilt control system 32'. Soft landing control system 210 includes a vibration sensor or accelerometer 250 attached directly to the vibrator 24 and operable to detect or sense the vibration of the vibrator 24. The vibration sensor 250 and the controller 238 thus may detect the soft or somewhat firm condition of the concrete at the vibrator 24 through measurement of the vibration reaction within the vibrator or vibrating member itself, as the vibrator engages the concrete surface.

As shown in FIG. 8A, soft landing control system 210 may be in a non-activated mode during normal operation of the screed head assembly 14', whereby the linear actuator 262 is retracted such that level sensor 34 is in its normal operating position and vibrator 24 is lowered into substantial engagement with the concrete surface. Soft landing control system 210 may be set to an activated mode (such as automatically or in response to a user input or switch 64 or the like) when the screed head assembly 14' is lowered down onto the concrete surface (as shown in FIG. 8B). The vibration sensor 250 senses the vibration reaction within the vibrator 24 and generates an output signal to the controller 238. The controller 238 controls an output signal to the linear actuator relay 256 and switch 260 depending on the vibration signal (as communicated by the vibration sensor 250), which is indicative of the condition of the concrete at the vibrator 24. Thus, the controller 238 enables the electric actuator 262 to extend or retract, thus adjusting the position or orientation of the level sensor 34. The screed head assembly 14' may then be rotated (such as either counterclockwise or clockwise in FIGS. 8A and 8B) to adjust the degree of engagement of the vibrating member 24 with the concrete surface by a predetermined amount, such as an amount predetermined according to the general slump condition of the concrete and/or data contained within a computer software program within the controller.

As shown in FIGS. 8A and 8B, controller 238 may also control the tilt control system 32', such as in a similar manner as described above with respect to controller 38 of tilt control system 32. The soft landing system 210 thus may be incorporated into the controls of the tilt control system 32' to reduce the components and control circuitry and the like for controlling the tilt or orientation of the screed head assembly during operation of the screed head assembly and screeding machine. For example, controller 238 may actuate relay 256 and switch 260 to retract actuator 262 to pivot level sensor 34 when the soft concrete is detected, and the controller may further actuate control valve 40 to retract actuators 42 to pivot screed head assembly 14' to lower vibrator 24 in response to the pivotal movement of the level sensor 34.

Figure 9A:
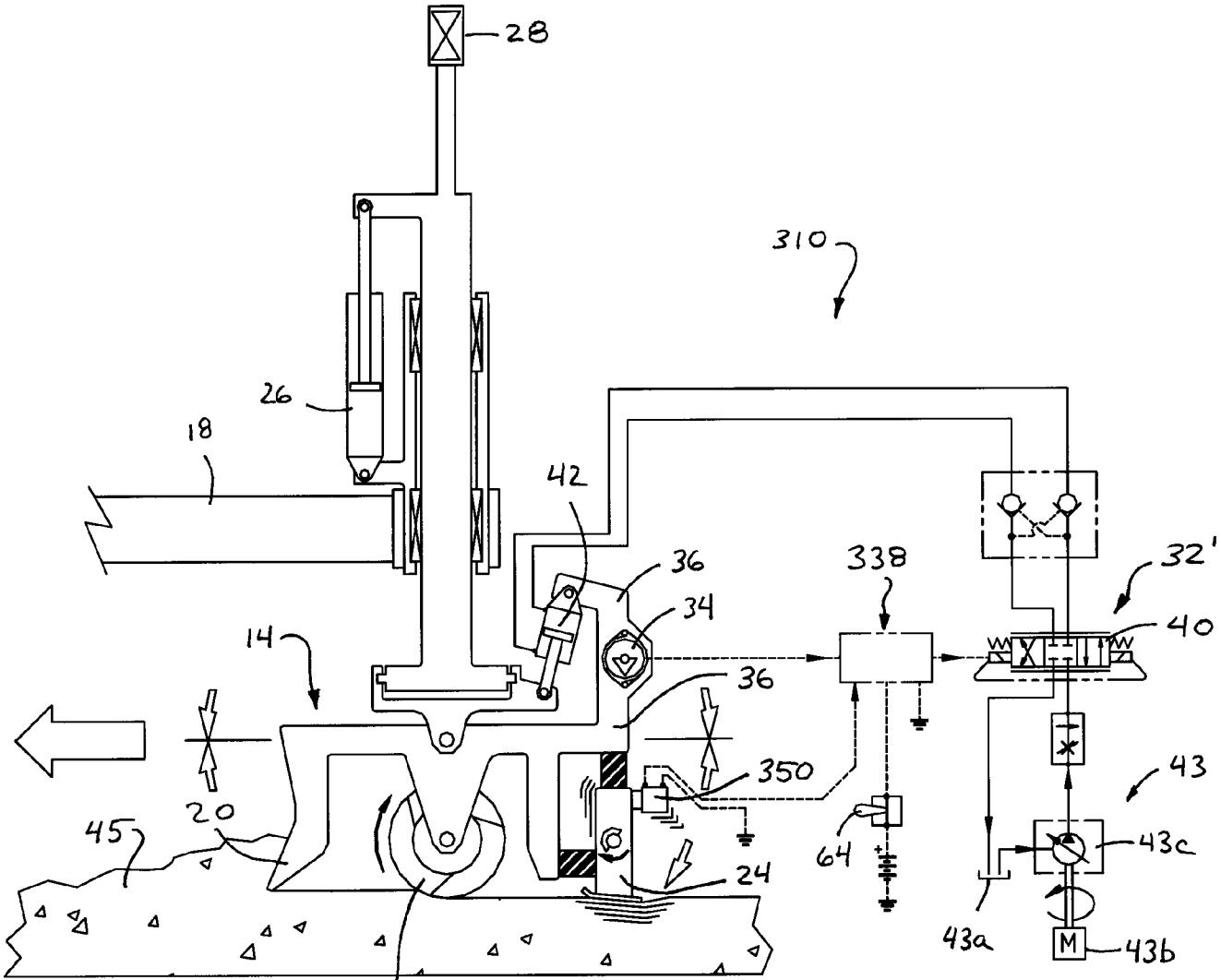
FIG. 9A is a side elevation and diagram of another soft landing control system of the present invention, shown in a non-activated mode.
Figure 9B:
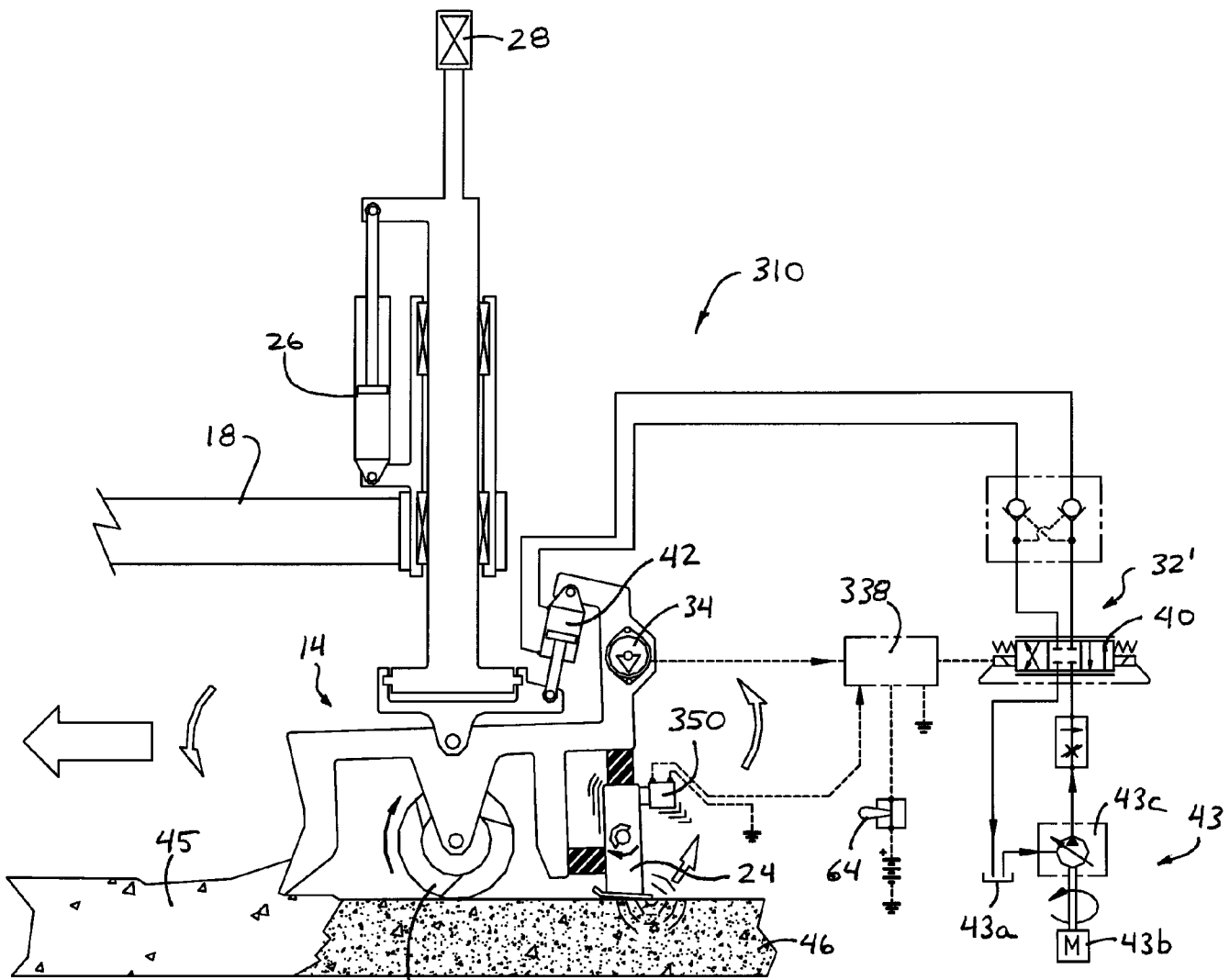
FIG. 9B is a side elevation and diagram of the control system of FIG. 9A, shown in an activated mode.

Referring now to FIGS. 9A and 9B, another soft landing control system 310 of the present invention includes a controller 338, which is operable to control the soft landing system 310 and to control the tilt control system 32'. Similar to soft landing control system 210, discussed above, soft landing control system 310 includes a vibration sensor or accelerometer 350 attached directly to the vibrator 24 to detect or sense the vibration reaction within the vibrator 24 during operation thereof. The vibrating sensor 350 and controller 338 are operable to detect the soft or somewhat firm condition of the concrete through measurement of the vibration reaction within the vibrating member 24 itself as the vibrating member at least partially engages and vibrates against the uncured concrete.

As shown in FIGS. 9A and 9B, level sensor 34 is positioned at frame 36 of screed head assembly 14 (and is not pivotally mounted to the frame as it is for screed head assembly 14' discussed above). Thus, and as can be seen with reference to FIGS. 8A and 9A, the electric linear actuator and relay to adjust the level sensor bias position is eliminated in soft landing control system 310. The level sensor bias position electrical signal is provided internally within the controller 338 of soft landing control system 310. Controller 338 thus may include programmable computer software and circuitry to determine the degree of adjustment or pivotal movement of the screed head assembly 14 based on the sensed input signal of the vibration sensor 350 (rather than on the sensor bias position signals from the level sensor when the level sensor is pivoted relative to the frame, such as described above). Although shown with a vibration sensor at the vibrator, the soft landing control system may include or incorporate various other types of sensors or switch actuation devices or the like in place of the vibration sensor, without affecting the scope of the present invention. The controller then may determine the proper orientation of the screed head assembly in response to signals from the other sensors or switch actuation devices or the like.

As shown in FIG. 9A, the soft control landing system 310 may be set to a non-activated mode during normal operation of the screed head assembly 14 as the screed head assembly 14 is moved over the concrete surface. Soft landing control system 310 may be operable in activated mode (such as automatically or in response to a user input or switch 64 or the like) as the screed head assembly is lowered down and into engagement with the concrete surface, such that the vibrator is only slightly or partially engaged with the concrete surface when the auger 22 is at the grade level (as shown in FIG. 9B). The controller 338 and the vibration sensor or accelerometer 350 directly attached to the vibrator 24 are operable to detect the firmness or softness of the concrete surface at or beneath the vibrator 24. When a somewhat firm condition indicative of previously screeded concrete is detected, the controller 338 maintains the control valve 40 and actuators or cylinders 42 in the position shown in FIG. 9B to maintain the vibrator 24 only slightly or partially engaged with the concrete surface. When a softer concrete condition (indicative of freshly placed and not previously screeded concrete) is detected, the controller 338 may actuate control valve 40 and actuators or cylinders 42 to rotate the screed head assembly 14 (such as in the clockwise direction in FIGS. 9A and 9B) to lower vibrator 24 into substantial or full engagement with the concrete surface.

The "level sensor bias position" electrical signal is thus provided internally within the controller of soft landing control system 310. More particularly, programmable computer software within the controller may be implemented to determine the sensor bias position signals based on the sensed input signal of the vibration sensor 350. Thus, the screed head assembly may be rotated (such as in the counterclockwise direction in FIG. 9B) to temporarily lift the vibrating member 350 upward from the concrete surface a desired amount, such as a predetermined amount that may be predetermined according to the general slump condition of the concrete or according to other parameters or data, and then may be again rotated in the opposite direction (such as in the clockwise direction in FIG. 9A) when a softer concrete condition is detected.

Referring now to FIGS. 10A-D, a soft landing control system 410 is incorporated into the tilt control system 32' and an elevation control system 470, which is operable to control the elevation of the screed head assembly 14. Elevation control system 470 includes a controller 472 that receives a signal from laser receivers 28 (in response to the laser receivers receiving the laser reference plane 29 generated by a remote laser plane generator) and extends or retracts the actuators 26 via a hydraulic control valve 474 or the like, in order to adjust the elevation of the screed head assembly 14 to position the auger or grade setting device 22 at the desired grade. Controller 438 of soft landing control system 410 also receives an input signal from controller 472 or from laser receiver 28 that is indicative of the elevation of the screed head assembly or auger relative to the desired grade.

Controller 438 is operable to rotate the screed head assembly 14 (such as in the clockwise direction in FIGS. 10A and 10D) to substantially engage the vibrator 24 with the concrete surface in response to a signal indicative of the screed head assembly approaching the concrete surface. Controller 438 may delay rotation of the screed head assembly for a period of time following the signal to allow sufficient time for the screed head assembly to be moved along the concrete surface to a position generally over the uncured and not previously screeded concrete 45. Clockwise rotation of the screed head and therefore lowering of the vibrating member and engagement of the vibrating member with the concrete may thus be adjustably selected to begin at a preset or predetermined distance above the desired concrete surface as the screed head is being lowered. The preset distance is detected by at least one of the pair of laser receivers 28 located at each end of the screed head assembly 14. The controller receives or identifies an initial signal (which may be indicative of the laser receiver receiving a separate signal that is separate from the laser plane and that is at the predetermined distance above the laser plane, or may be indicative of the laser receiver receiving the laser plane at a lower portion of the laser receiver below the centerline or target point of the laser receiver), and may include an adjustable or programmable time delay to delay clockwise rotation of the screed head assembly and lowering of the vibrating member after receiving the signal, as discussed below.

Figure 10A:
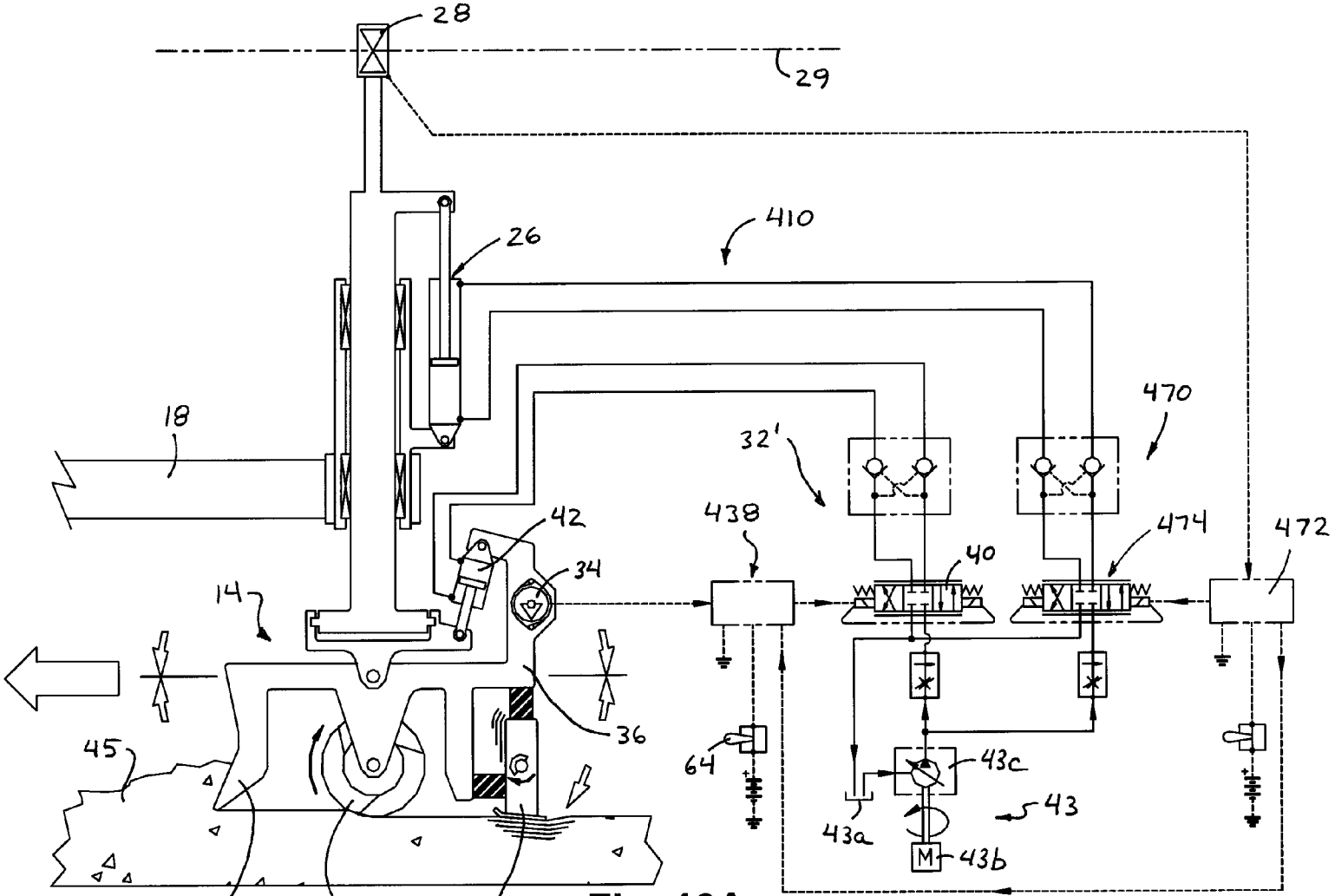
FIG. 10A is a side elevation and diagram of another soft landing control system of the present invention, shown in a non-activated mode.

As shown in FIG. 10A, the soft landing control system 410 may initially be in a non-activated mode during normal operation of the screed head assembly 14, such that vibrator 24 is engaged with the concrete surface at the desired level. The soft landing control system 410 may be switched to an activated mode (such as automatically or in response to a user input or switch 64) when the screed head assembly is raised from the concrete surface or as the screed head assembly is being lowered toward the concrete surface. For example, the screed head assembly 14 may be automatically rotated (such as in the counterclockwise direction in FIGS. 10B and 10C) to raise the vibrating member relative to the auger when the screed head is raised from the concrete surface at the end of a screeding pass. As the screed head is lowered to the concrete surface at the beginning of the next screeding pass, rotation of the screed head (such as in the clockwise direction in FIGS. 10A and 10D) is enabled by means of the appropriate signal from the laser receiver 28.

Figure 10B:
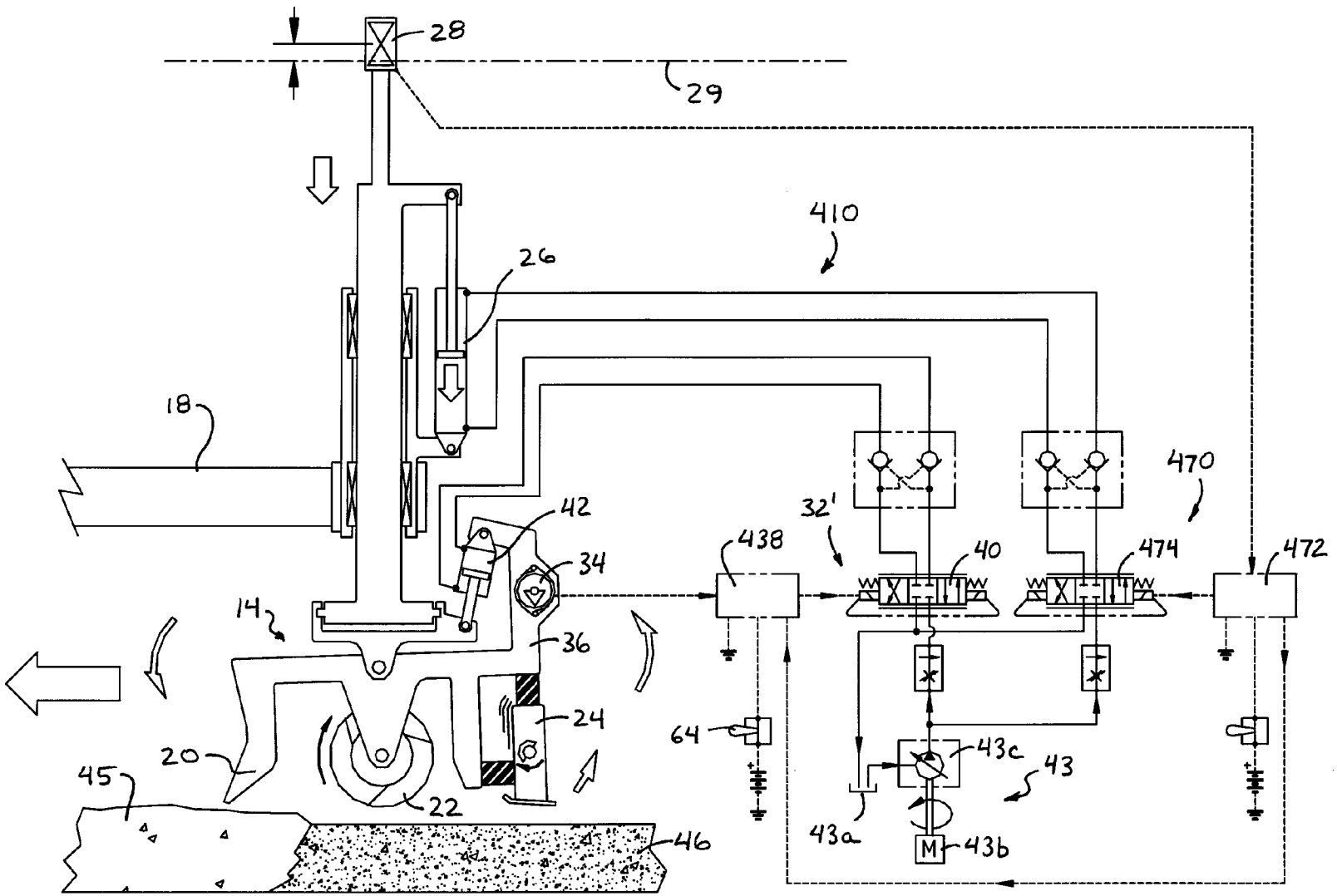
FIG. 10B is a side elevation and diagram of the control system of FIG. 10A, shown in an activated mode.

The controller receives and identifies and responds to the input signal when the laser receiver 28 is at a preset or predetermined distance above the on-grade laser reference plane 29 (and thus when the grade setting device or auger 22 is at the predetermined distance above the desired grade). For example, the laser receiver 28 may detect the reference plane at a lower portion of the receiver (as shown in FIG. 10B) and may communicate the appropriate signal at that time, or the laser receiver may detect a second reference plane or the like at a height slightly above the on-grade laser reference plane 29 and may communicate the appropriate signal at that time. Optionally, and preferably, the laser receiver may continually send or communicate an electrical signal to the controller that is indicative of the location of the laser plane along the laser receiver, and the controller will determine when the laser receiver is at the predetermined distance below the target and, thus, when the auger is at the predetermined distance above the desired grade. The controller 438 may then control or adjust actuators 42 via control valve 40 to rotate or pivot the screed head assembly to lower the vibrator or vibrating member toward the ground in response to such a determination.

Figure 10C:
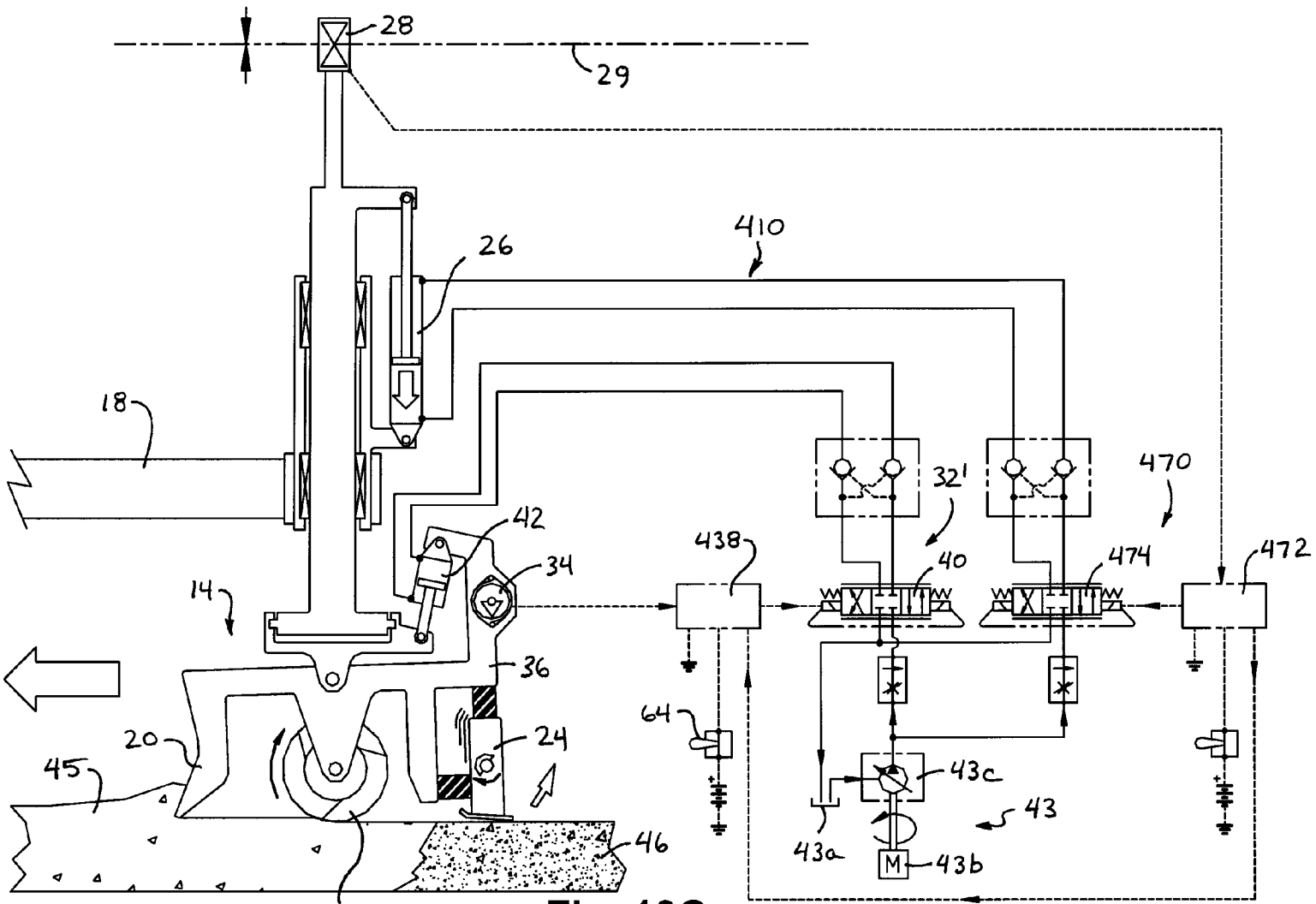
FIG. 10C is a side elevation and diagram of the control system of FIGS. 10A and 10B, where the screed head is lowered to the concrete surface while clockwise rotation of the screed head and engagement of the vibrating member with the concrete surface is delayed by an adjustable timer within the controller.
Figure 10D:
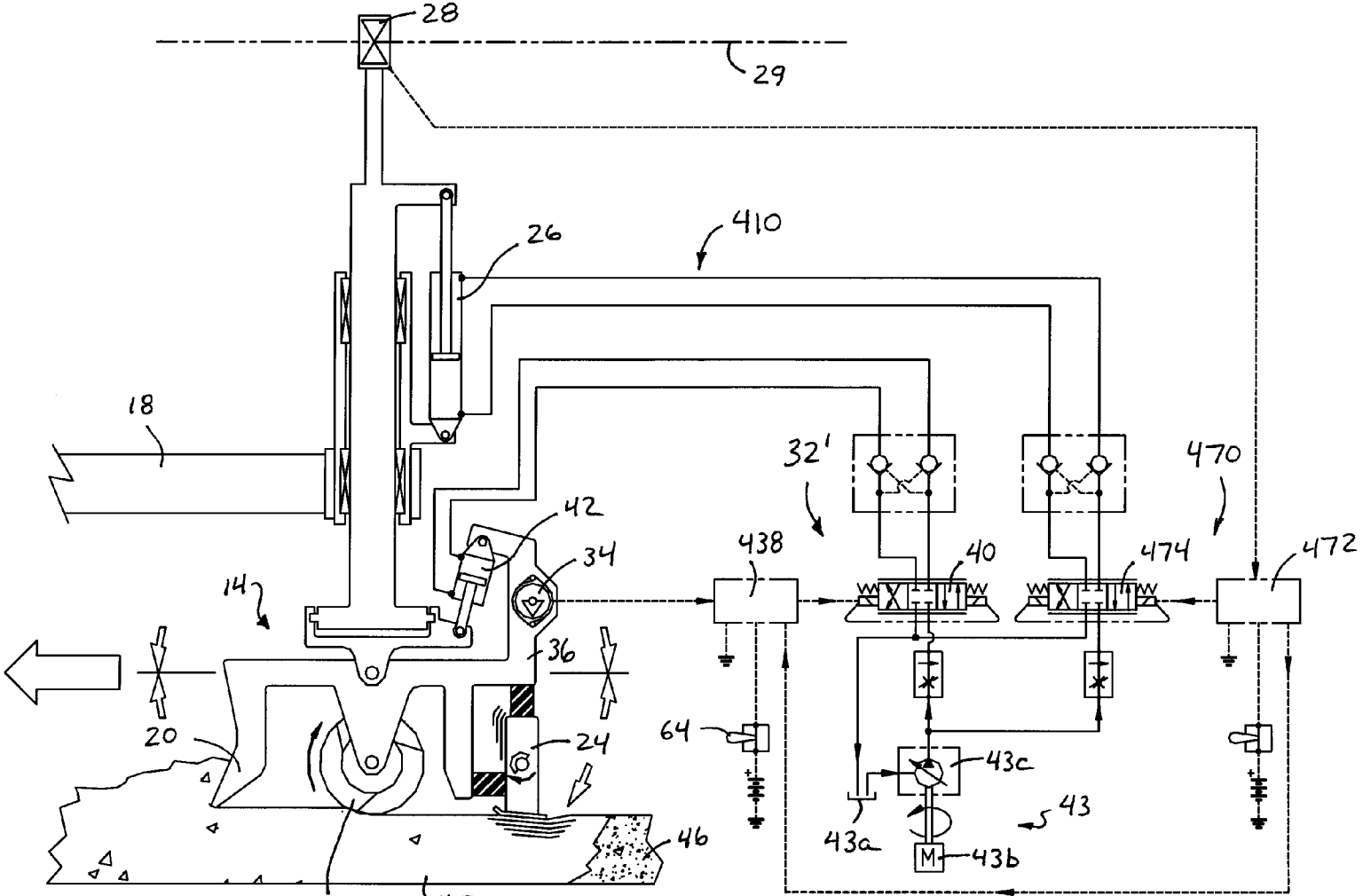
FIG. 10D is a side elevation and diagram of the control system of FIGS. 10A-C, where the clockwise rotation of the screed head and engagement of the vibrating member with the concrete surface is smoothly timed to occur at the transition between the previously screeded, somewhat firm concrete and the soft, unscreeded concrete as the screed head moves steadily forward.

The rotation of the screed head assembly and lowering of the vibrating member may be delayed by an adjustable or programmable timer within the controller, in order to delay lowering of the vibrating member until the screed head assembly has moved a sufficient distance or amount along the concrete surface. Soft landing control system 410 thus may delay rotation of the screed head assembly to prevent vibrator 24 from engaging the concrete surface where the screed head assembly is initially lowered. As shown in FIG. 10C, the screed head assembly may be initially lowered to the concrete surface, while the clockwise rotation of the screed head and engagement of the vibrating member with the concrete surface is delayed by an adjustable timer within the controller 438. As the screed head assembly moves forward, the delay helps to avoid the vibrating member from fully or substantially engaging the previously screeded and somewhat firm concrete 46. As shown in FIG. 10D, after the screed head assembly 14 has moved along the concrete surface a sufficient amount (or after the time delay period has elapsed), the controller 438 may rotate the screed head assembly to substantially engage the vibrating member with the concrete surface to screed the uncured concrete area 45. Clockwise rotation of the screed head and substantial engagement of the vibrating member with the concrete surface thus is smoothly timed to occur generally at the transition between the previously screeded and somewhat firm concrete and the soft unscreeded concrete as the screed head moves steadily forward over and along the concrete surface.

Referring now to FIGS. 11A-D, another soft landing control system 410' of the present invention includes a single controller 438' that is operable to control the soft landing control system 410', the tilt control system 32' and the elevation control system 470' of the screed head assembly 14 and screeding machine. Soft landing control system 410' may be substantially similar to soft landing control system 410 discussed above, except the separate controllers 438 and 472 are combined into a single controller 438' in control system 410'. Also, the vibrating member 24' is attached to the screed head assembly 14 by means of generally vertical low-friction slide bearings 425 or the like. The vibrating member 24' thus may be independently raised and lowered relative to the frame 36 of the screed head assembly 14 by a pair of electric linear actuators 462 at each end of the vibrator or vibrating member 24'. This eliminates the need to tilt or rotate the entire screed head assembly as shown in the other soft landing control system embodiments discussed above.

Figure 11A:
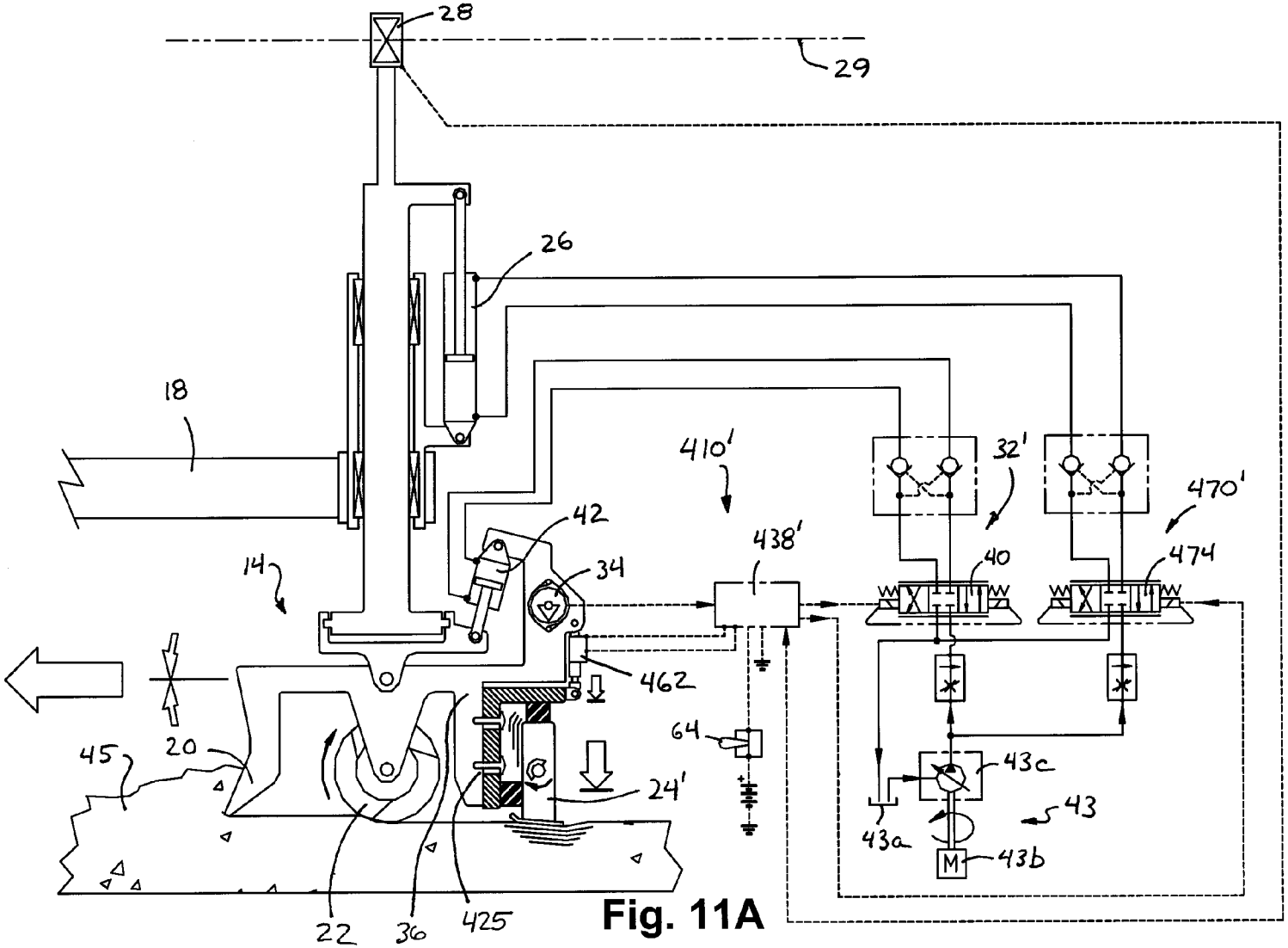
FIG. 11A is a side elevation and diagram of another soft landing control system of the present invention, shown in a non-activated mode.

As shown in FIG. 11A, soft landing control system 410' may be in a non-active mode during normal operation of the screed head assembly 14. The soft landing control system 410' may be switched to an activated mode (such as automatically or in response to a user input or switch 64 or the like), such as when the screed head assembly is raised upward from the concrete surface or as the screed head assembly is lowered toward and onto the concrete surface. For example, the electric linear actuators 462 may automatically retract the vibrating member or vibrator 24' whenever the screed head assembly 14 is raised at the end of a screeding pass. The vibrator 24' may remain raised relative to the screed head assembly until the screed head assembly 14 is again lowered toward and onto the concrete surface for the next screeding pass.

Figure 11B:
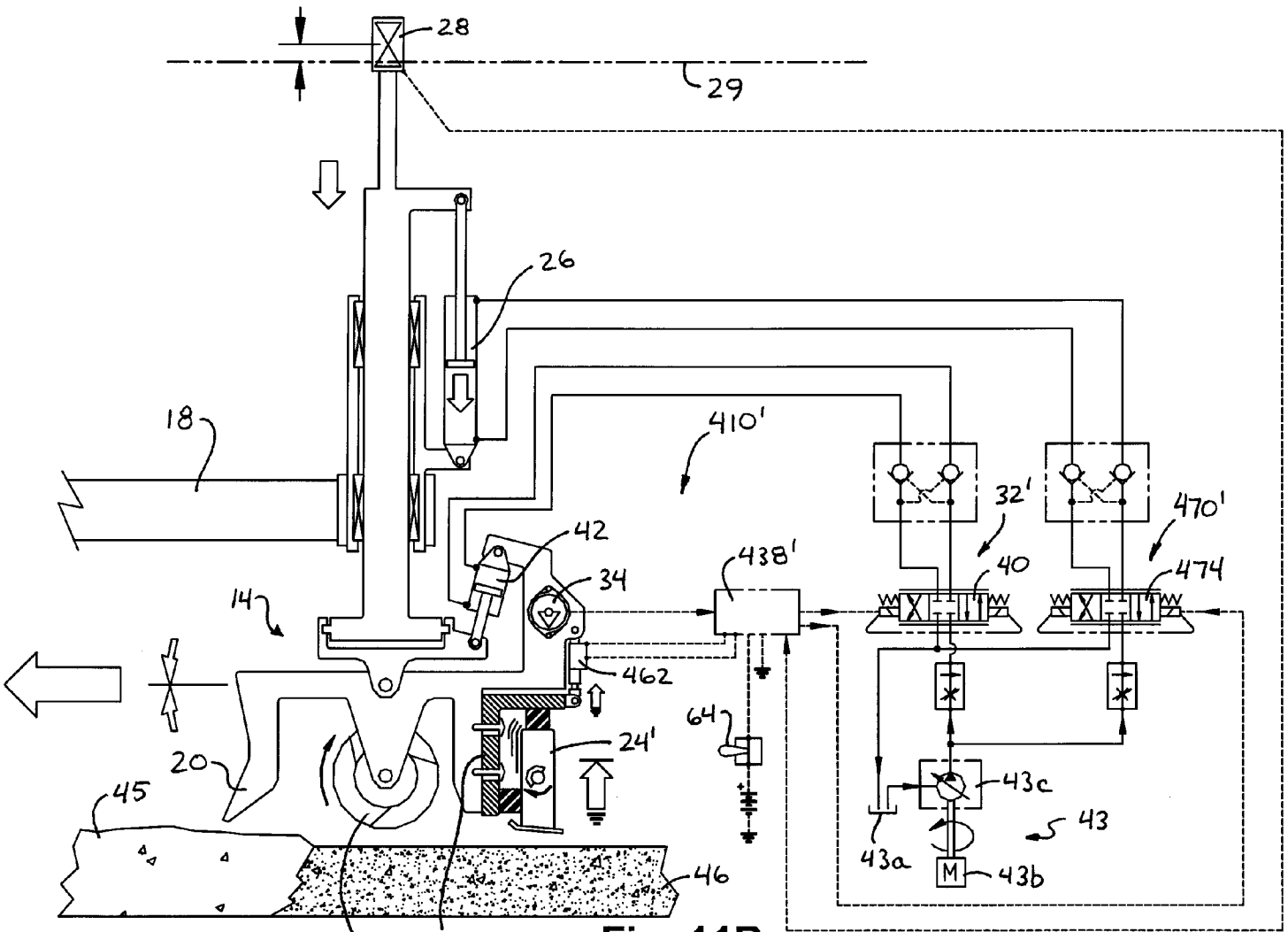
FIG. 11B is a side elevation and diagram of the control system of FIG. 11A, shown in an activated mode.
Figure 11C:
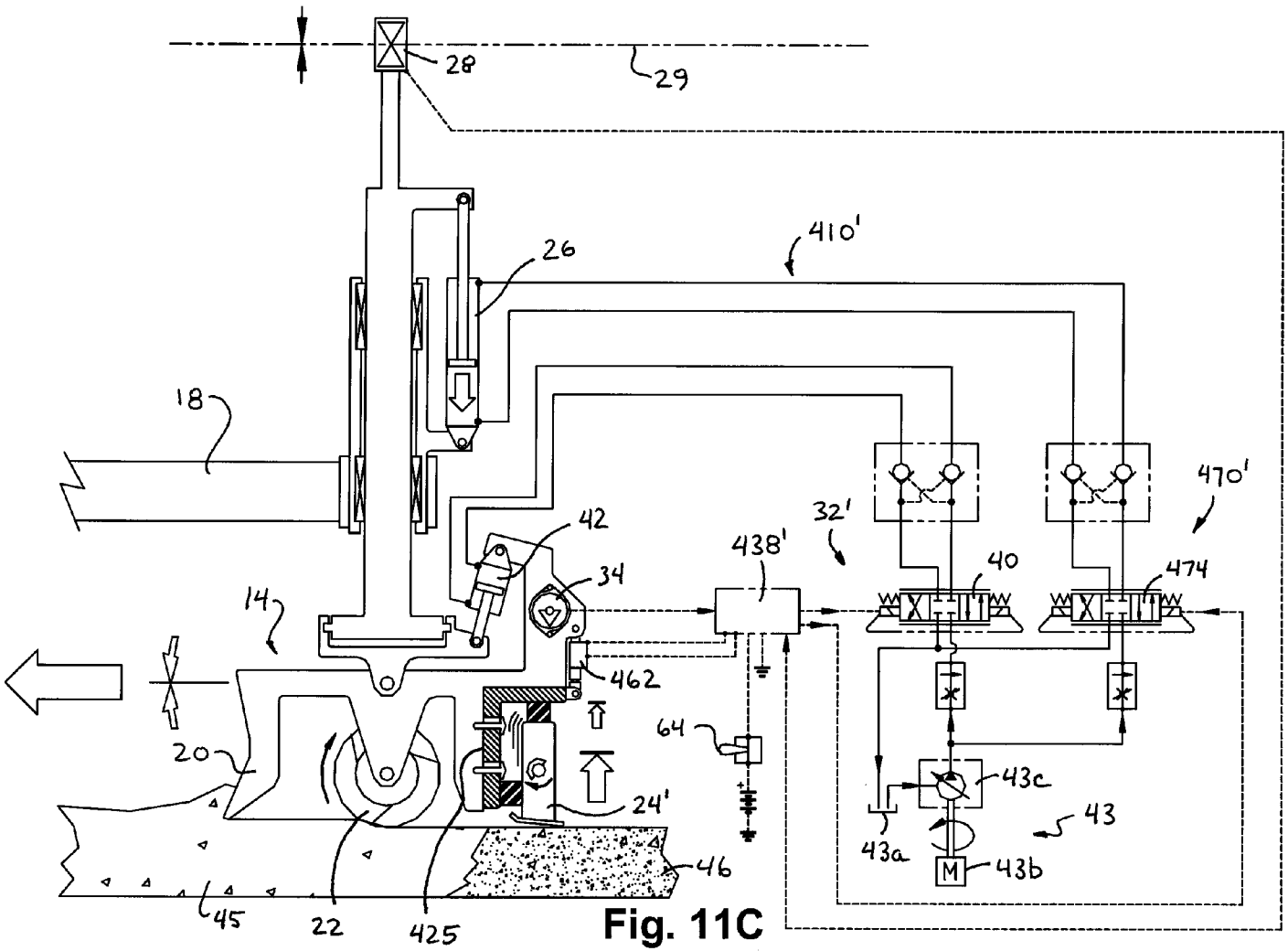
FIG. 11C is a side elevation and diagram of the control system of FIGS. 11A and 11B, showing the system as the screed head is lowered to the concrete surface.

As shown in FIG. 11B, laser receiver 28 may signal controller 438' so that controller 438' may determine when screed head assembly 14 is lowered toward the concrete surface and is at a predetermined height above the desired grade level, such as in a similar manner as described above. While the screed head assembly 14 is lowered toward and onto the concrete surface, controller 438' may hold actuators 462 in their retracted state to maintain the vibrator 24' in its raised position for a predetermined time period following the determination that the screed head assembly 14 is at the predetermined height above the grade. As shown in FIG. 11C, controller 438' may continue to maintain vibrator 24' in its raised position after the screed head assembly and auger are positioned at the desired grade level as determined by the laser receiver detecting the laser reference plane 29. After the time period has elapsed (and during which the screed head assembly is moved over and along the concrete surface), controller 438' may extend actuators 462 to lower vibrator 24' into substantial engagement with the uncured concrete surface 45.

Figure 11D:
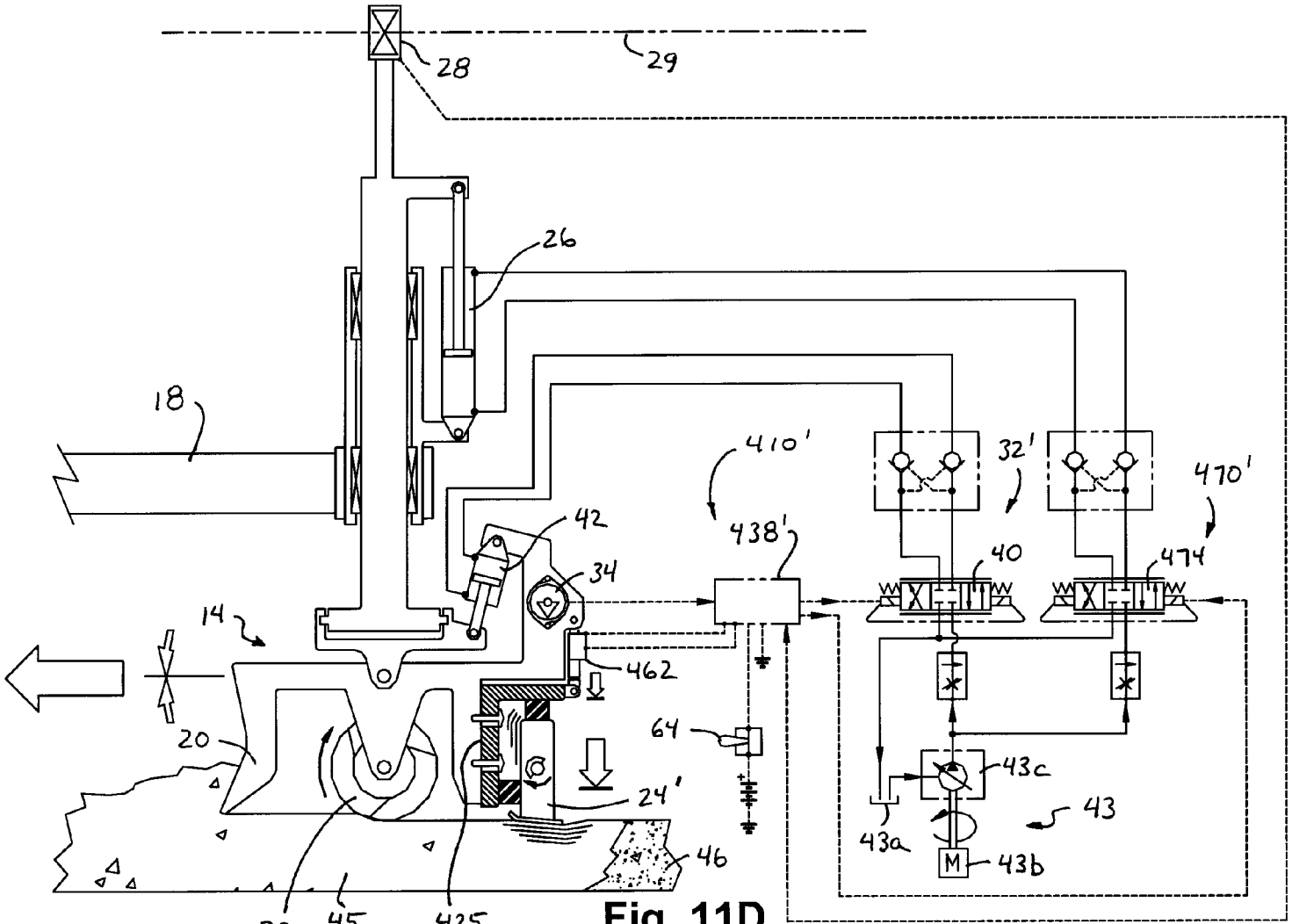
FIG. 11D is a side elevation and diagram of the control system of FIGS. 11A-C, where engagement of the vibrating member with the concrete surface is smoothly timed to occur near the transition between the previously screeded, somewhat firm concrete and the soft, unscreeded concrete as the screed head moves steadily forward.

As shown in FIG. 11D, the time delay may be sufficient to allow the screed head assembly 14 to move over and along the concrete surface (to the left in FIG. 11D) to a location where the vibrator 24' is positioned over the uncured and not previously screeded concrete area 45. The electric actuators 462 thus are extended to engage the vibrating member with the concrete surface in a smoothly timed manner such that substantial engagement of the vibrator with the concrete surface occurs near the transition between the previously screeded and somewhat firm concrete and the soft unscreeded concrete as the screed head moves steadily forward. As discussed above, the controller may include an adjustable timer within the controller that delays the engagement of the vibrating member with the concrete surface for a selected or predetermined period of time. As the screed head moves forward, the selected delay helps avoid engaging the vibrating member with the previously screeded and somewhat firm concrete 46. The selected delay period may be selected depending on the operator's preferences or the desired or predicted speed of travel of the screed head assembly or other characteristics of the operator or screeding device or concrete being screeded, without affecting the scope of the present invention.

Figure 12A:
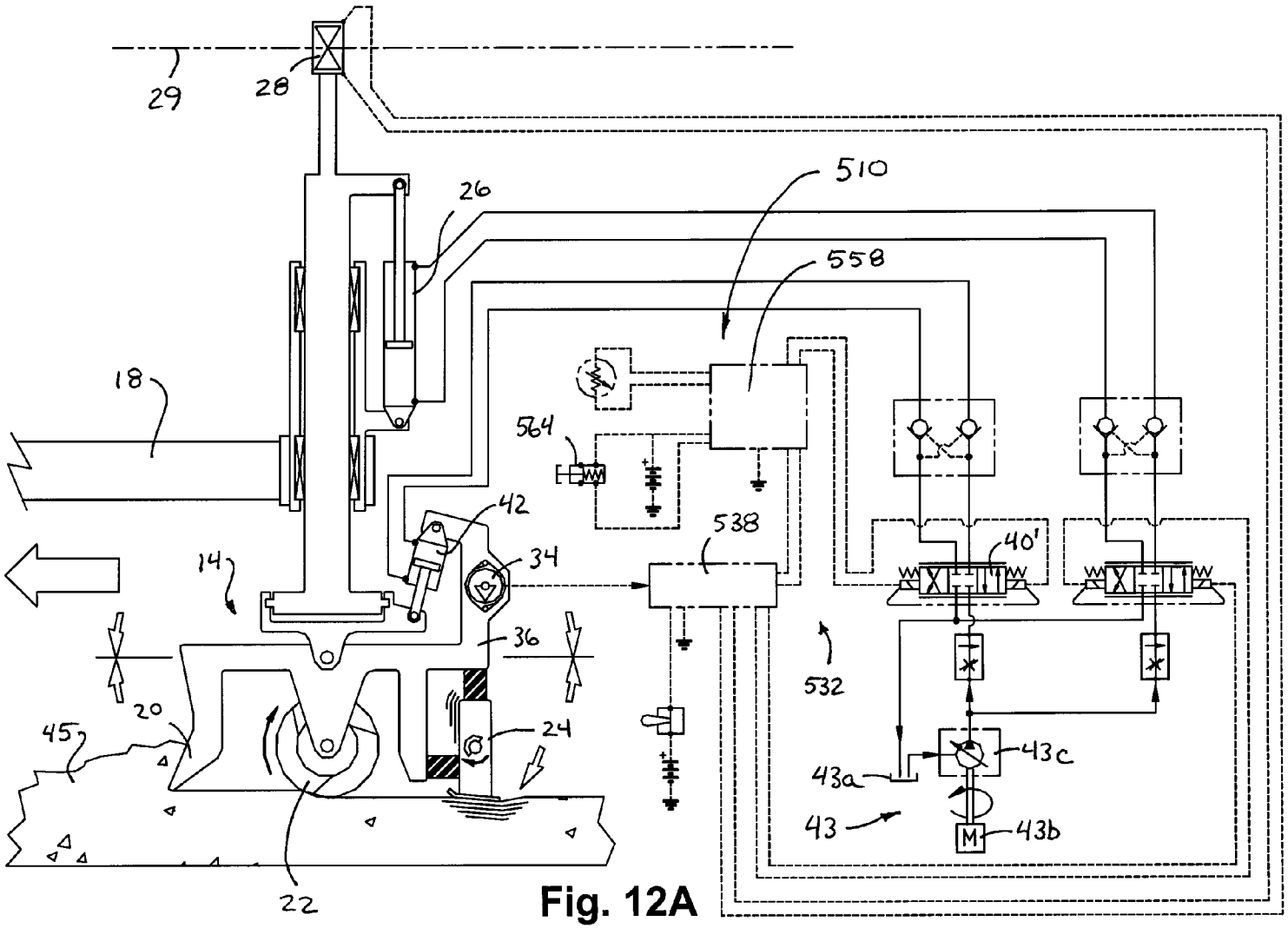
FIG. 12A is a side elevation and diagram of another soft landing control system of the present invention, shown in a non-activated mode.
Figure 12B:
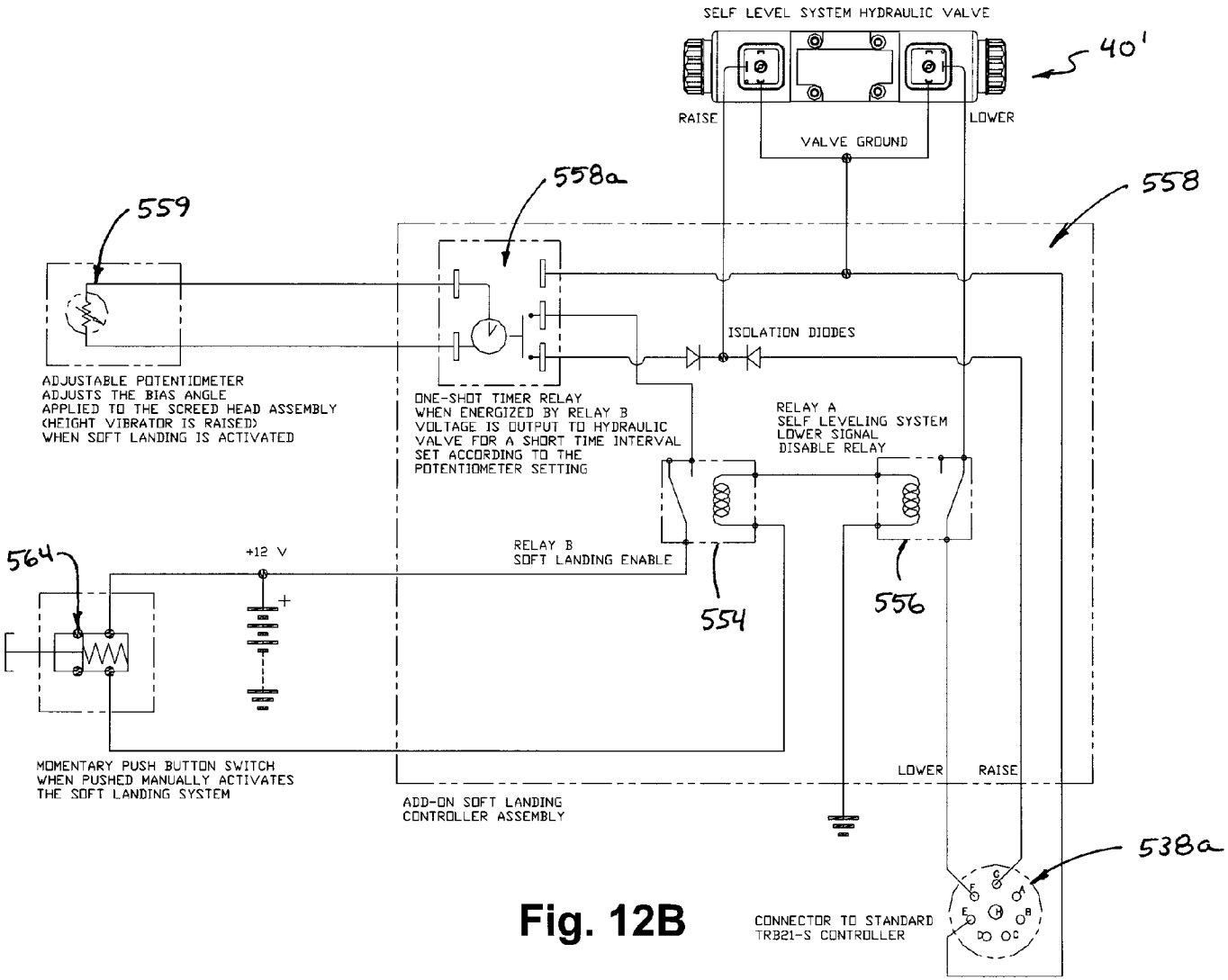
FIG. 12B is a diagram of the control elements contained within the soft landing control system of FIG. 12A.

Referring now to FIGS. 12A and 12B, another soft landing control system 510 of the present invention may be added or implemented between the screed tilt and elevation controller 538 and the hydraulic valve 40' for adjusting the actuators 42 to adjust the tilt or orientation of the screed head assembly 14. In the illustrated embodiment, the soft landing control system is implemented with the controls of a LASER SCREED™ screeding machine, with the soft landing controller 558 added between the screed elevation controller 538 and the hydraulic valve 40'. The soft landing controller 558 thus may comprise a kit that may be optionally added to a LASER SCREED™ screeding machine or to other types of screeding machines not originally equipped with this control feature. In the illustrated embodiment, manual activation of the soft landing control system 510 occurs when a momentary push button switch 564 is depressed or actuated to temporarily close the circuit through the switch. However, other user inputs or manual inputs or buttons or switches or sensors or the like may be implemented, without affecting the scope of the present invention.

When the input or switch 564 is actuated, controller 558 causes rotation (such as in the counterclockwise direction in FIG. 12A) of the screed head assembly 14 and thus raising of the vibrator 24 by briefly activating the screed head self-leveling hydraulic valve 40' to extend actuators 42 via an electric pulse from a delay timer 558*a* (FIG. 12B). The screed head assembly 14 and vibrator 24 may be held in the pivoted or rotated orientation until an appropriate time and/or location for the vibrator 24 to be lowered into engagement with the concrete surface. For example, the screed head assembly 14 and vibrating member 24 may return to the normal screeding position (shown in FIG. 12A) either automatically at the end of a timed cycle (such as if an auto mode is selected), or upon release of the momentary push-button 564 (such as if a manual mode is selected).

As shown in FIG. 12B, controller 558 may include a pair of relays 554, 556 for enabling the soft landing function or disabling the self leveling function, respectively, depending on whether or not switch 564 is activated. For example, if switch 564 is deactivated as shown in FIG. 12B, relay 554 is open, while relay 556 is closed such that the control signals for the tilt/leveling control system pass through the soft landing controller to control the valve 40' to adjust the actuators 42. The controller 558 also may include or contain a solid-state one-shot timer-relay or timing device 558*a* or the like. The length of the timed delay may be adjustable by means of an adjustable potentiometer 559 or the like. As can be seen with reference to FIG. 12B, controller 558 may be connected in line between the output 538*a* of the controller 538 of the self leveling or tilt control system 532 and the control valve 40', and thus may be readily added or implemented on an existing screeding machine or device, and thus may be added as an aftermarket soft landing control system or the like.

As discussed above, activation of the soft landing control system 510 occurs when the momentary push button switch 564 is depressed or actuated. Relay 556 is then energized to interrupt or disable the normal self leveling or lowering signal to the hydraulic valve 40', while relay 554 is energized to enable or activate the raise signal to the hydraulic valve 40' for a period of time controlled by the one-shot delay timer 558*a*. The length of the delay determines the height and/or period of time that the vibrating member is temporarily raised from the concrete surface. The delay period is selected to provide sufficient time for the screed head assembly to be moved over and along the concrete surface a sufficient distance such that the vibrator is located over the uncured and not-screeded area of the concrete, such as discussed above.

Figure 13:
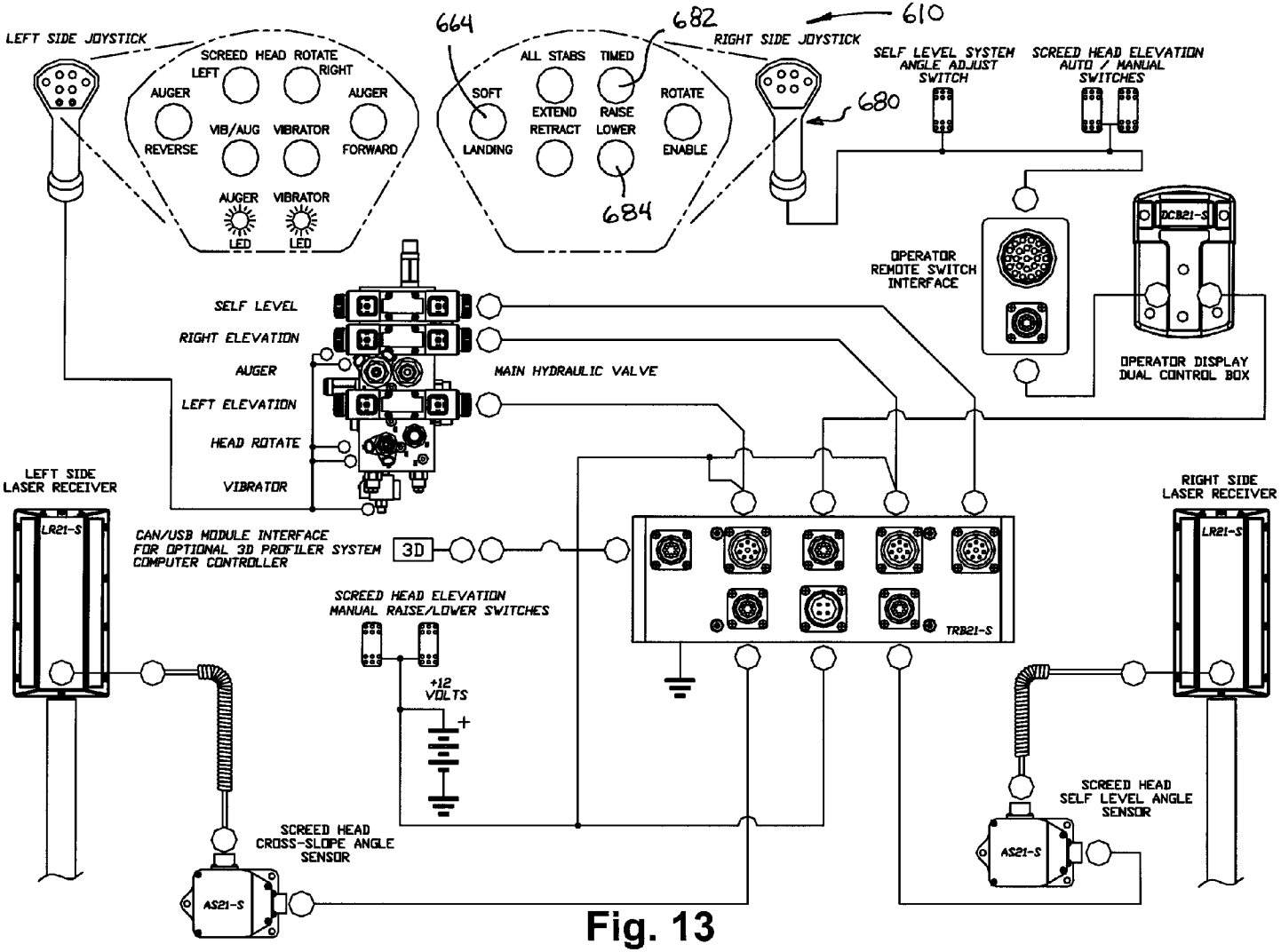
FIG. 13 is a general diagram of control hardware and wiring harnesses suitable for use in a soft landing control system of the present invention, where the control system is fully incorporated within an original equipment manufactured control system.

Optionally, and as can be seen with reference to FIG. 13, a soft landing control system 610 may be incorporated within the controls and systems and original equipment of the screeding machine. For example, a soft landing actuation button or input 664 may be included in one of the joysticks or controls 680 of the screeding machine such that an operator may readily activate the soft landing function at an appropriate time during operation of the screeding machine. The soft landing control system of FIG. 13 may be any of the embodiments described herein or may be any variation thereof, without affecting the scope of the present invention.

Figure 14:
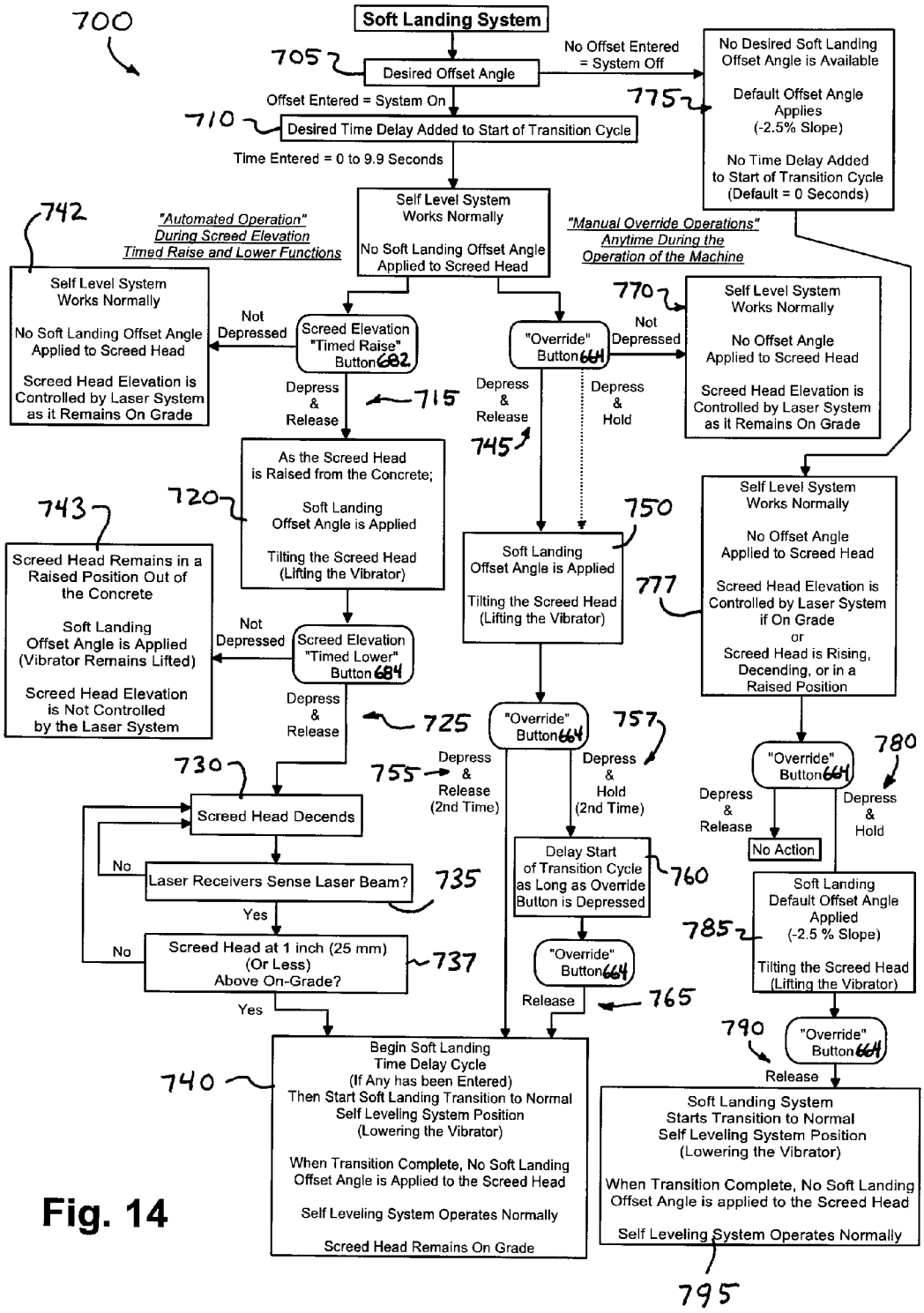
FIG. 14 is a flow chart showing a soft landing process of the present invention.

Referring now to FIG. 14, a soft landing process 700 for lowering the screed head assembly into engagement with the concrete surface is shown. A desired offset angle may be entered at 705 (such as entering into the control system or software, such as via a keypad or the like) in order to set a desired degree of raising or lifting of the vibrating member or vibrator when the soft landing system is activated. Also, a desired time delay may also be entered at 710 to set the time it takes following an activating event for the vibrator to be lowered into substantial engagement with the concrete surface. If a screed elevation "timed raise" button 682 (FIG. 13) is depressed and released at 715, the soft landing offset angle may be automatically applied at 720 by tilting or rotating the screed head assembly (or lifting the vibrator) as the screed head assembly is raised from the concrete surface following a screeding pass over the concrete surface (or at any other time between the end of one pass and the start of the next pass). As the screed head assembly is positioned generally at the start of the next pass (such as generally over an overlap area or previously screeded area), a screed elevation "timed lower" button or input 684 (FIG. 13) may then be depressed and released at 725, and the screed head may be lowered at 730 until the laser receivers detect the laser beam (such as at a location where the auger or grade setting device is a predetermined distance above the desired grade) at 735. When the screed head is at the predetermined distance above grade at 737, such as at approximately one inch (25 mm) or less (or more if desired) above grade, the soft landing time delay cycle may begin at 740. The vibrator is then lowered during a soft landing transition to the normal self leveling position. When the transition is complete, the vibrator is at its normal operating position or orientation and no soft landing offset angle is applied to the screed head assembly. The self leveling system then operates normally and the screed head assembly remains generally on grade via the laser leveling system.

If the timed raise button 682 is not depressed at the start of the pass, the self leveling system operates in a normal manner at 742 and no soft landing offset angle is applied to the screed head assembly or vibrator. The screed head elevation may then be controlled by the laser leveling system as it remains generally on grade. Also, if the timed raise button 682 is depressed, but the timed lower button 684 is not depressed, the screed head assembly may remain in its raised position above the concrete at 743 while the soft landing offset angle is applied (or while the vibrator remains lifted). The screed head remains lifted above the concrete and its elevation remains not controlled by the laser system.

Optionally, an override button 664 (FIG. 13) may be provided to activate or deactivate the time delay start of the soft landing system. The override button 664 may function to manually activate the soft landing system at anytime during operation of the screeding machine. If the override button is depressed and released at 745, the soft landing offset angle may be applied at 750 to set the vibrator at its raised orientation relative to the auger or grade setting device (such as by tilting the screed head assembly or raising the vibrator as discussed above). The override button may be depressed and released a second time (at 755) to begin the soft landing delay cycle at 740 (discussed above). Optionally, if the override button is depressed and held (at 757) during the second actuation of the button, the system delays the start of the transition cycle at 760 until the override button is released at 765, whereby the soft landing time delay cycle may begin at 740 (discussed above). If the override button is not depressed at all, the self level system operates in its normal manner at 770 and no offset angle or elevation is applied to the vibrator, and the screed head assembly elevation may be controlled by the laser system in the normal manner to maintain the screed head assembly generally on grade.

As can be seen in FIG. 14, if no offset angle is entered, the soft landing control system is deactivated, and the vibrator is set to its normal operating position or orientation. The control may be set at 775 to have a default offset angle (such as approximately a −2.5% slope or thereabouts), and may be set to have a default time delay to start the transition cycle (such as zero seconds or any other desired default setting). Because the soft landing system is deactivated, the screed head assembly operates in the normal manner at 777. However, if the override button 664 is depressed and held at 780, the default offset angle may be applied at 785 to the vibrator by tilting or raising the vibrator. When the override button is released at 790, the soft landing system starts its transition (at 795) to the normal self leveling system position by tilting the screed head assembly or lowering the vibrator toward and into engagement with the concrete surface. When the transition cycle is complete, the vibrator is at its normal operating position or orientation with no soft landing offset angle applied and the self leveling system operates in the normal manner as the screed head assembly is moved over and along the concrete surface.

Optionally, the control may further comprise a vibration control, and may function to automatically deactivate the vibrator motor of the vibrating member when the screed head assembly is not being moved over and along the concrete surface in the screeding direction (i.e., the direction toward the screeding machine, such as to the left in FIGS. 4-12). The control thus may deactivate the vibrator motor of the vibrating member when the vibrating member is not being moved along the concrete surface, in order to reduce or substantially preclude any depressions from being formed in the concrete surface in situations where movement of the screed head assembly may be stopped while the vibrating member is engaged with the concrete surface. When movement of the screed head assembly commences in the screeding direction, the control may automatically re-activate the vibrator motor to again vibrate the vibrating member as it is moved over and along the concrete surface in the screeding direction.

Optionally, the control may be operable to provide a "soft start" or to "ramp up" the frequency of the vibrator motor when movement in the screeding direction commences. For example, the control may initially activate the vibrator motor at a low frequency when movement is first detected or indicated, and may slowly and/or steadily increase the vibration frequency to the operational frequency (which is higher than the initial low frequency) as the screed head assembly is moved over and along the concrete surface in the screeding direction. The vibrator soft-start control thus may allow the screed head assembly to move a short distance in the screeding direction before the vibrating member comes up to full speed. This soft start feature serves to lessen the impact of the vibrator motor starting too suddenly and forcefully while the vibrating member remains stationary upon the uncured concrete.

Optionally, the soft start function may comprise a hydraulic flow ramp-up feature that may be added to the vibrator control system of the screeding machine. For example, the vibrator control system may consist of a small hydraulic accumulator connected to the input port of a hydraulically driven vibrator motor. The hydraulic accumulator may be charged with a pressurized gas, such as nitrogen gas or the like at a pressure of approximately 200 p.s.i. (although other gasses and/or pressures may be implemented without affecting the scope of the present invention). A floating piston may separate the nitrogen gas from the hydraulic fluid. When at rest, the floating piston is forced toward the single inlet port of the accumulator, whereby all the hydraulic oil is forced out of the accumulator housing. When the vibrator function is first engaged (i.e., when the vibrator motor is activated in response to movement of the screed head assembly in the screeding direction), the pressurized hydraulic fluid that would normally start the vibrator motor turning is momentarily diverted into the accumulator. The fluid is initially diverted because pressurized hydraulic fluid always seeks the path of least resistance, and the starting pressure for the motor is at least slightly higher than the nitrogen pressure behind the piston of accumulator. The pressurized fluid thus initially flows into the accumulator, but as the pressure increases, the hydraulic fluid also enters the vibrator motor and begins gradually rotating the motor to cause the vibration of the vibrating member. As the pressure continues to increase, more fluid enters the vibrator motor to increase the motor speed until the vibrator motor is operating at its full speed or operational speed. The control thus may automatically delay the vibrator motor from reaching full speed too quickly and effectively prolongs spin-up of the motor to full speed.

Optionally, an operator of the screeding machine may select the vibration control function at the controls of the screeding machine. For example, an operator may select an "on" or "auto" or "off" control setting at a vibrator master switch of the screeding machine. The vibrator master switch may comprise a rocker type electrical switch that controls the on-off operation of the screed head vibrator. When the off position is selected, the hydraulically driven vibrator motor (or other type of vibrator motor or vibrating device) is disabled and will not operate. When the auto position is selected, the vibrator motor may only operate while the screed head assembly is being moved or driven in the screeding direction over and along the concrete surface. If movement of the screed head assembly is momentarily stopped while screeding the concrete in the screeding direction, the control will automatically stop or deactivate the vibrator motor. If the screed head assembly is moved in the opposite or non-screeding direction, the vibrator motor may remain stopped or deactivated. However, when the screed head assembly is again moved in the screeding direction, the control may automatically activate the vibrator motor (and may ramp up the speed of the vibrator motor as discussed above) to continue to vibrate the vibrating member and thus to vibrate and screed the concrete surface as the screed head assembly is moved over and along the concrete surface in the screeding direction. The movement of the screed head assembly may be detected or determined via any sensing means (that may detect movement of the screed head assembly along the concrete surface in the screeding direction) or the like, or the vibrator control may be operable in response to a signal indicative of the screeding machine moving the screed head assembly over and along the concrete surface (such as a signal that is generated in response to actuation of a hydraulic cylinder that causes retraction of the support boom to move the screed head assembly toward the machine), without affecting the scope of the present invention.

Such a vibrator control or system and/or soft start control or system may be implemented with a screeding machine or device of the type shown in FIG. 1 and discussed above, or may be implemented with other types of screeding devices, such as a small, manually movable or wheeled screeding device, such as the types described in U.S. pat. application, Ser. No. 10/266,305, filed Oct. 8, 2002, now U.S. Pat. No. 6,976,805, and in PCT application NO. PCT/US02/32205, filed Oct. 8, 2002 and published Apr. 17, 2003 as Publication No. WO 03/031751, which are hereby incorporated herein by reference, without affecting the scope of the present invention. In such manually movable screeding devices, the screed head assembly may be partially supported by the vibrating member as the vibrating member makes contact with and rests upon the surface of the uncured concrete. If the vibrating member is vibrated while it remains stationary and while it is supported upon uncured concrete, the vibrating member will have a tendency to sink into the concrete and may thus cause a depression in the concrete surface. Thus, turning off the vibrator motor whenever the screed head assembly is stopped will limit or substantially preclude the vibrating member from sinking into the concrete and causing an undesired depression in the uncured concrete. Also, ramping up the activation of the vibrator motor further limits or substantially precludes the formation of such undesired depressions. However, although particularly suited for such manually movable screeding devices or machines where the vibrating member floats or rests on the uncured concrete surface, the vibration control system may be equally suitable for use with other types of screeding machines and the like, without affecting the scope of the present invention.

Although several embodiments of the soft landing control system of the present invention have been shown and described herein, these embodiments are exemplary of the present invention, and the present invention is not intended to be limited only to these embodiments. Other soft landing control systems that control the landing or engagement of the vibrating member with the concrete surface to reduce or substantially preclude depressions or irregularities from occurring in or at the previously screeded concrete may be implemented without affecting the scope of the present invention. Also, although shown with hydraulic cylinders or electric actuators, other actuators or motors or the like may be implemented to adjust or control the movement of the screed head assembly and/or the level sensor and/or the vibrating member and the like, without affecting the scope of the present invention. Also, other sensing devices, such as movable sensors or wheels or the like and/or vibration sensors and/or contact switches and/or optical sensors and/or sonic proximity sensors and/or other sensors or sensing means for determining when the vibrator is generally at or near the uncured concrete may be implemented without affecting the scope of the present invention. It is further envisioned that various aspects of the embodiments shown and described herein may be implemented in other embodiments or systems as well or combined with various aspects of the other embodiments, without affecting the scope of the present invention.

Therefore, the present invention provides a soft landing control system that is operable to rotate or pivot the screed head assembly or otherwise adjust or move the vibrator or vibrating member of the screed head assembly into substantial engagement with the concrete surface at an appropriate time and location to limit or reduce or substantially preclude substantial engagement of the vibrator with a previously screeded and partially cured area of the concrete. The present invention thus limits or avoids damage to or irregularities in the concrete surface that may occur if the vibrator engages and depresses against the overlap areas of the concrete surface that have already been screeded. The soft landing control system automatically controls the lowering of the vibrator and may lower the vibrator into substantial engagement with the concrete surface in response to a time delay from the initial lowering of the screed head assembly or from activation of the soft landing control system, such as from a manual input or the like. Optionally, the soft landing control system may automatically control the lowering of the vibrator and may lower the vibrator into substantial engagement with the concrete surface in response to a vibration detection or soft concrete detection that is indicative of the screed head assembly and/or vibrator being moved to an area of the concrete that is uncured and not yet screeded. The soft landing control system thus is operable to automatically lower the vibrator into substantial engagement with the concrete surface in response to an activating or triggering event or signal and at an appropriate time following the activating or triggering event or signal and/or at an appropriate location of the vibrator over the concrete surface. Optionally, the control system may be operable to automatically control the vibrator motor or device in response to movement of the screed head assembly over and along the concrete surface, in order to limit or substantially preclude depressions from being formed in the concrete surface when movement of the screed head assembly is temporarily stopped while the vibrating member is engaged with the concrete surface. When movement of the screed head assembly commences in the screeding direction, the vibrator motor may be activated to begin vibrating the vibrating member, and may be ramped up from an initial low vibration frequency to a higher operational frequency as the screed head assembly is moved over and along the concrete surface.

Changes and modifications to the specifically described embodiments can be carried out without departing from the principles of the present invention, which is intended to be limited only by the scope of the appended claims as interpreted according to the principles of patent law.

The embodiments of the invention in which an exclusive property or privilege is claimed are defined as follows:

1. A screeding device for screeding a concrete surface having a partially cured concrete area and a newly placed concrete area, said screeding device comprising:

a support member;

a screed head assembly adjustably mounted to said support member, said screed head assembly comprising a grade setting device and a vibrating member, said screed head assembly being lowerable to move said grade setting device to a desired grade at the concrete surface at the partially cured concrete area, said screed head assembly being movable over and along the concrete surface by said support member; and a soft landing control operable to automatically lower said vibrating member relative to said grade setting device after said grade setting device is lowered to the desired grade, said soft landing control being operable to delay lowering said vibrating member relative to said grade setting device at least until said control receives an input indicative of at least a portion of said screed head assembly being moved to a position generally over the newly placed concrete area.

2. The screeding device of claim 1, wherein said soft landing control is operable lower said vibrating member relative to said grade setting device a period of time following the time at which said control receives said input.

3. The screeding device of claim 1, wherein said soft landing control is operable to adjust the level of said vibrating member relative to said grade setting device via pivotal movement of said screed head assembly about a pivot axis extending generally along said screed head assembly and generally parallel to the desired grade of the concrete surface.

4. The screeding device of claim 1, wherein said soft landing control is operable to adjust the level of said vibrating member relative to said grade setting device via generally vertical movement of said vibrating member relative to a frame of said screed head assembly.

5. The screeding device of claim 1 including a vibration sensing device operable to sense the vibration generally at the concrete surface, said soft landing control delaying lowering said vibrating member at least until said soft landing control determines that said vibration is indicative of newly placed concrete.

6. The screeding device of claim 5, wherein said vibration sensing device engages the concrete surface when said grade setting device is engaged with the concrete surface, said vibration sensing device being operable to sense vibration in the concrete.

7. The screeding device of claim 5, wherein said vibration sensing device is attached to said vibrating member and is operable to sense vibration reaction in said vibrating member when said vibrating member is activated and partially engaged with the concrete surface.

8. The screeding device of claim 1 including a concrete contacting switch positioned in front of said grade setting device, said soft landing control receiving an input from said switch in response to said switch contacting excess uncured concrete in front of said grade setting device, said input being indicative of said switch being at the newly placed concrete area.

9. The screeding device of claim 8, wherein said soft landing control includes a timing device and is operable to delay lowering said vibrating member toward and into engagement with the concrete surface until a period of time has elapsed following said soft landing control receiving said input from said switch.

10. The screeding device of claim 1, wherein grade setting device comprises an auger rotatable to cut and establish the desired grade at the concrete surface.

11. The screeding device of claim 1, wherein said screed head assembly includes a plow at a forward end of said screed head assembly and forward of said grade setting device.

12. The screeding device of claim 1, wherein said support member comprises an extendable and retractable boom mounted to a movable base unit, said support member being retracted to move said screed head assembly over and along the surface of the newly placed concrete area to screed the newly placed concrete.

* * * * *